US009374854B2

(12) United States Patent
Quilici et al.

(10) Patent No.: US 9,374,854 B2
(45) Date of Patent: Jun. 21, 2016

(54) LIGHTING TECHNIQUES UTILIZING SOLID-STATE LAMPS WITH ELECTRONICALLY ADJUSTABLE LIGHT BEAM DISTRIBUTION

(71) Applicants: Michael Quilici, Essex, MA (US); Seung Cheol Ryu, Marblehead, MA (US); Lori Brock, Ipswich, MA (US)

(72) Inventors: Michael Quilici, Essex, MA (US); Seung Cheol Ryu, Marblehead, MA (US); Lori Brock, Ipswich, MA (US)

(73) Assignee: OSRAM SYLVANIA INC., Wilmington, MA (US)

( * ) Notice: Subject to any disclaimer, the term of this patent is extended or adjusted under 35 U.S.C. 154(b) by 0 days.

(21) Appl. No.: 14/531,375

(22) Filed: Nov. 3, 2014

(65) Prior Publication Data

US 2016/0128140 A1 May 5, 2016

(51) Int. Cl.
*H05B 37/02* (2006.01)
*H05B 33/08* (2006.01)

(52) U.S. Cl.
CPC ..... *H05B 33/08* (2013.01); *H05B 37/02* (2013.01); *H05B 37/0254* (2013.01)

(58) Field of Classification Search
USPC ..... 315/291, 294, 299; 362/249.02, 294, 362/296.01, 341, 378
See application file for complete search history.

(56) References Cited

U.S. PATENT DOCUMENTS

2010/0046226 A1 2/2010 Cox et al.
2011/0051420 A1 3/2011 Gill
2012/0026732 A1 2/2012 Fricke
2012/0112661 A1 5/2012 van de Ven et al.
2012/0113640 A1 5/2012 Markle et al.
2012/0206918 A1 8/2012 Lee et al.
2013/0026922 A1* 1/2013 Allen et al. ..... 315/113
2014/0015436 A1* 1/2014 Vissenberg et al. ..... 315/250

(Continued)

FOREIGN PATENT DOCUMENTS

KR 20090000762 1/2009
WO 0124583 A1 4/2001
WO 2007125520 A1 11/2007

OTHER PUBLICATIONS

Prouteau, Evelyne, International Search Report and Written Opinion of the International Search Authority for PCT/US2015/058537, Jan. 11, 2016, European Patent Office, Rijswijk, The Netherlands (12 pages).

(Continued)

*Primary Examiner* — Thuy Vinh Tran
(74) *Attorney, Agent, or Firm* — Andrew Martin

(57) ABSTRACT

Solid-state lamps having an electronically adjustable light beam distribution are disclosed. In accordance with some embodiments, a lamp configured as described herein includes a plurality of solid-state emitters (addressable individually and/or in groupings) mounted over a non-planar interior surface of the lamp. The interior mounting surface can be concave or convex, as desired, and may be of hemispherical or hyper-hemispherical geometry, among others, in accordance with some example embodiments. In some embodiments, the heat sink of the lamp may be configured to provide the interior mounting surface, whereas in some other embodiments, a separate mounting interface, such as a parabolic aluminized reflector (PAR), a bulged reflector (BR), or a multi-faceted reflector (MR), may be included to such end. Also, the lamp may include one or more focusing optics for modifying its output. In some cases, a lamp provided as described herein may be configured for retrofitting existing lighting structures.

27 Claims, 15 Drawing Sheets

(56) References Cited

U.S. PATENT DOCUMENTS

| | | | | |
|---|---|---|---|---|
| 2014/0070699 | A1* | 3/2014 | Genthon et al. | 315/82 |
| 2014/0160744 | A1 | 6/2014 | Wimberly | |
| 2014/0191686 | A1* | 7/2014 | Maxik et al. | 315/307 |
| 2014/0301071 | A1* | 10/2014 | Jorgensen et al. | 362/231 |

OTHER PUBLICATIONS

Prouteau, Evelyne, International Search Report and Written Opinion of the International Searching Authority, for counterpart application PCT/US2015/058540, Jan. 4, 2016, European Patent Office, Rijswijk, The Netherlands, 12 pages.

* cited by examiner

Figure 3
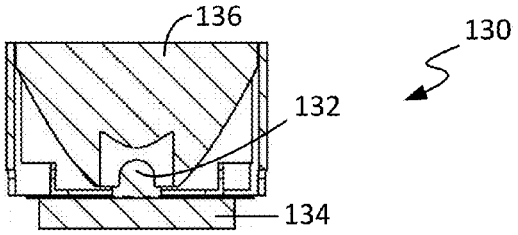
Figure 4A
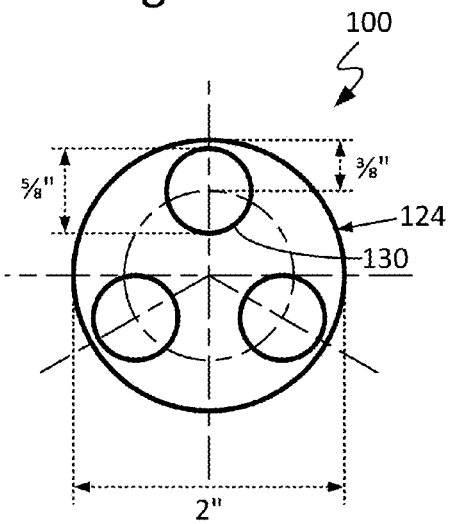
Figure 4B
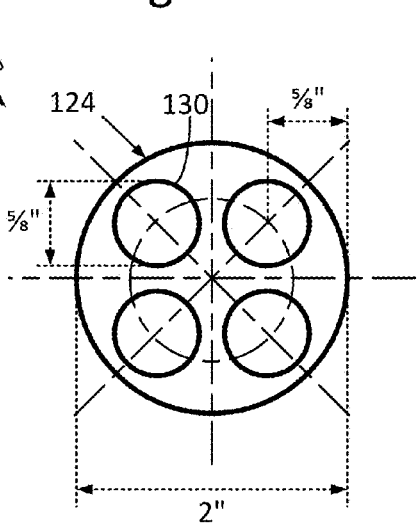
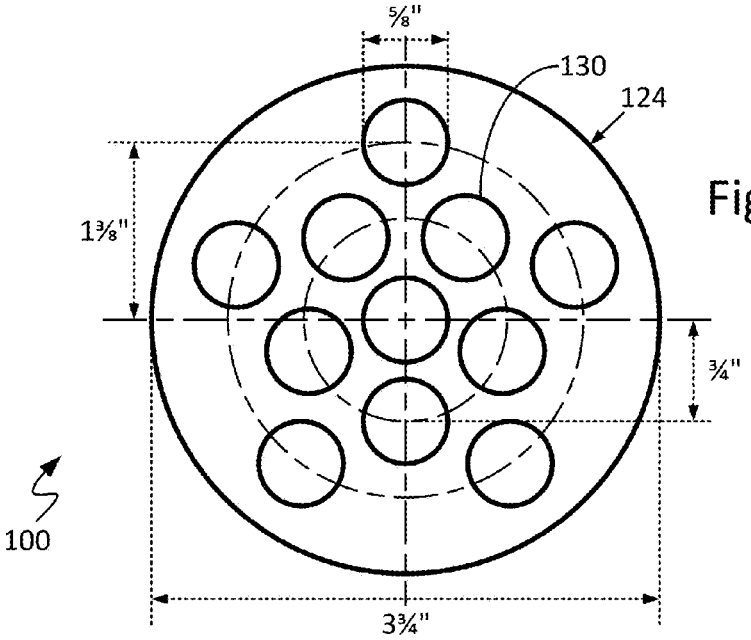
Figure 4C 100
Example
Light Beam
Distribution 100
Example
Light Beam
Distribution
Beam
Spots

LIGHTING TECHNIQUES UTILIZING SOLID-STATE LAMPS WITH ELECTRONICALLY ADJUSTABLE LIGHT BEAM DISTRIBUTION

CROSS-REFERENCE TO RELATED APPLICATIONS

This application is related to U.S. Non-Provisional patent application Ser. No. 14/531,427, filed on Nov. 3, 2014, U.S. Non-Provisional patent application Ser. No. 14/032,821, filed on Sep. 20, 2013, and U.S. Non-Provisional patent application Ser. No. 14/032,856, filed on Sep. 20, 2013, each of which is herein incorporated by reference in its entirety.

FIELD OF THE DISCLOSURE

The present disclosure relates to solid-state lighting (SSL) and more particularly to light-emitting diode (LED)-based lamps.

BACKGROUND

Traditional adjustable lighting fixtures, such as those utilized in theatrical lighting, employ mechanically adjustable lenses, track heads, gimbal mounts, and other mechanical parts to adjust the angle and direction of the light output thereof. Mechanical adjustment of these components is normally provided by actuators, motors, or manual adjustment by a lighting technician. However, the cost of such designs is normally high given the complexity of the mechanical equipment required to provide the desired degree of adjustability. In addition, existing designs generally include relatively large components, making their form factors too large for retrofit applications.

BRIEF DESCRIPTION OF THE DRAWINGS

FIG. 3 is a cross-sectional view of a solid-state light source configured in accordance with an embodiment of the present disclosure.

FIG. 4A is a plan view of a solid-state lamp configured for retrofitting a MR16 socket/enclosure, in accordance with an example embodiment of the present disclosure.

FIG. 4B is a plan view of a solid-state lamp configured for retrofitting a MR16 socket/enclosure, in accordance with another example embodiment of the present disclosure.

FIG. 4C is a plan view of a solid-state lamp configured for retrofitting a PAR30 socket/enclosure, in accordance with another example embodiment of the present disclosure.

Figure 1A:
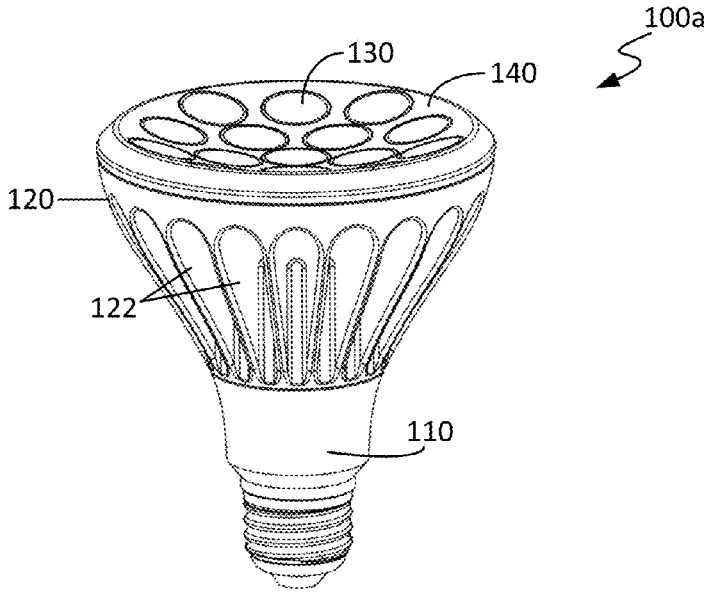
FIG. 1A is a perspective view of a lamp configured in accordance with an embodiment of the present disclosure.

These and other features of the present embodiments will be understood better by reading the following detailed description, taken together with the figures herein described. The accompanying drawings are not intended to be drawn to scale. In the drawings, each identical or nearly identical component that is illustrated in various figures may be represented by a like numeral. For purposes of clarity, not every component may be labeled in every drawing.

DETAILED DESCRIPTION

Solid-state lamps having an electronically adjustable light beam distribution are disclosed. In accordance with some embodiments, a lamp configured as described herein includes a plurality of solid-state emitters mounted over a non-planar interior surface of the lamp. In accordance with some embodiments, a given emitter may be individually addressable and/or addressable in one or more groupings, as desired for a given target application or end-use. The interior mounting surface can be concave or convex, as desired, and may be of hemispherical or hyper-hemispherical geometry, among others, in accordance with some example embodiments. In some embodiments, the heat sink of the lamp may be configured to provide the interior mounting surface, whereas in some other embodiments, a separate mounting interface, such as a parabolic aluminized reflector (PAR), a bulged reflector (BR), or a multi-faceted reflector (MR), may be included to such end. Also, the lamp may include one or more focusing optics for modifying its output. In some cases, a lamp provided as described herein may be configured for retrofitting existing lighting structures. Numerous configurations and variations will be apparent in light of this disclosure.

General Overview

For adjusting light distribution, existing lighting designs rely upon mechanical movements provided using motors or other moving components manipulated by a user. However, the cost of such designs is normally high given the complexity of the mechanical equipment required to provide the desired degree of adjustability. In addition, existing designs generally include relatively large components, making their form factors too large for retrofit luminaire applications.

Thus, and in accordance with some embodiments of the present disclosure, solid-state lamps having an electronically adjustable light beam distribution are disclosed. In accordance with some embodiments, a lamp configured as described herein includes a plurality of solid-state emitters mounted over a non-planar interior surface of the lamp. In accordance with some embodiments, a given emitter may be individually addressable and/or addressable in one or more groupings, as desired for a given target application or end-use. The interior mounting surface can be concave or convex, as desired, and may be of hemispherical or hyper-hemispherical geometry, among others, in accordance with some example embodiments. In some embodiments, a portion of the heat sink of the lamp may be configured to serve as the interior mounting surface, whereas in some other embodiments, a separate mounting interface, such as a parabolic aluminized reflector (PAR), a bulged reflector (BR), or a multi-faceted reflector (MR), may be included to such end. Also, the lamp may include one or more focusing optics for modifying its output. In some cases, a lamp provided as described herein may be configured for retrofitting existing lighting structures.

In accordance with some embodiments, a lamp configured as described herein can be communicatively coupled with one or more controllers and driver circuitry that can be used to electronically control the output of the solid-state emitters individually and/or in conjunction with one another (e.g., as an array/grouping or partial array/grouping), thereby electronically controlling the output of the lamp as a whole. In some cases, a lamp provided as described herein may be configured for electronic adjustment, for example, of its beam direction, beam angle, beam distribution, and/or beam diameter, thereby allowing for customizing the spot size, position, and/or distribution of light on a given surface of incidence. In some cases, a lamp configured as described herein may provide for electronic adjustment, for example, of its brightness (dimming) and/or color of light, thereby allowing for dimming and/or color mixing/tuning, as desired. In accordance with some embodiments, the plurality of pre-positioned, solid-state emitters of a lamp configured as described herein may be controlled individually to manipulate beam angle and distribution, for example, without the need for mechanically moving parts and physical access to the host socket. In a more general sense, and in accordance with an embodiment, the properties of the light output of a lamp configured as described herein may be adjusted electronically without need for mechanical movements, contrary to existing lighting systems.

In accordance with some embodiments, control of the emission of a lamp configured as described herein may be provided using any of a wide range of wired and/or wireless control interfaces, such as a switch array, a touch-sensitive surface or device, and/or a computer vision system (e.g., that is gesture-sensitive, activity-sensitive, and/or motion-sensitive, for example), to name a few. In some instances, a wireless software-based control interface may be utilized for intelligent control of light distribution, allowing a user to quickly and easily reconfigure the lighting in a given space, as desired.

As will be appreciated in light of this disclosure, a lamp configured as described herein may provide for flexible and easily adaptable lighting, capable of accommodating any of a wide range of lighting applications and contexts, in accordance with some embodiments. For example, some embodiments may provide for downlighting adaptable to small and large area tasks (e.g., high intensity with adjustable distribution and directional beams). Some embodiments may provide for accent lighting or area lighting of any of a wide variety of distributions (e.g., narrow, wide, asymmetric/tilted, Gaussian, batwing, or other specifically shaped beam distribution). By turning ON/OFF and/or dimming/brightening the intensity of various combinations of solid-state emitters of the lamp, the light beam output may be adjusted, for instance, to produce uniform illumination on a given surface, to fill a given space with light, or to generate any desired area lighting distributions. Numerous suitable uses and applications will be apparent in light of this disclosure.

In accordance with some embodiments, a lamp provided as described herein can be configured for installment or other operative coupling with a recessed light, a pendant light, a sconce, or the like which may be mounted, for example, on a ceiling, wall, floor, step, or other suitable surface, as will be apparent in light of this disclosure. In some other embodiments, a lamp provided as described herein can be configured for installment or other operative coupling with a free-standing lighting device, such as a desk lamp or torchière lamp. In some still other embodiments, a lamp provided as described herein may be configured for installment or other operative coupling with a fixture mounted, for example, on a drop ceiling tile (e.g., 2 ft.×2 ft., 2 ft.×4 ft., 4 ft.×4 ft., or larger) for installment in a drop ceiling grid. Numerous other suitable configurations will be apparent in light of this disclosure.

As will be further appreciated in light of this disclosure, a lamp configured as described herein may be considered, in a general sense, a robust, intelligent, multi-purpose lighting component capable of producing a highly adjustable light output without requiring mechanical movement of lighting componentry. Some embodiments may provide for a greater level of light beam adjustability, for example, as compared to traditional lighting designs utilizing larger moving mechanical parts. Some embodiments may realize a reduction in cost, for example, as a result of the use of longer-lifespan solid-state devices and reduced installation, operation, and other labor costs. Furthermore, the scalability and orientation of a solid-state lamp configured as described herein may be varied, in accordance with some embodiments, to adapt to a specific lighting context or application (e.g., downward-facing, such as in a drop ceiling lighting fixture, a pendant lighting fixture, a desk light, etc.; upward-facing, such as in indirect lighting aimed at a ceiling). In accordance with some embodiments, a lamp configured as described herein may allow for great flexibility with respect to lighting direction and distribution in a relatively compact component for use in retrofitting existing lighting fixtures.

Structure and Operation

Figure 1B:
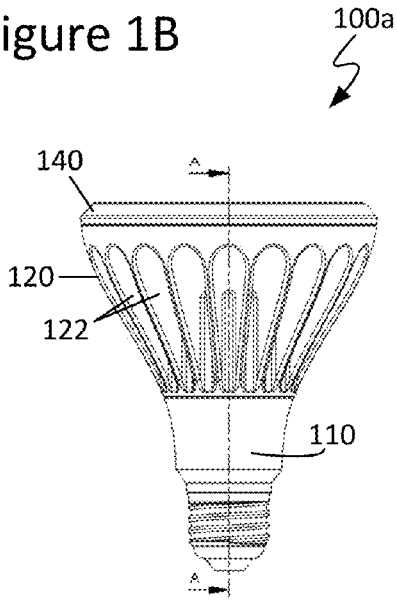
FIG. 1B is a side view of the lamp of FIG. 1A.
Figure 1C:
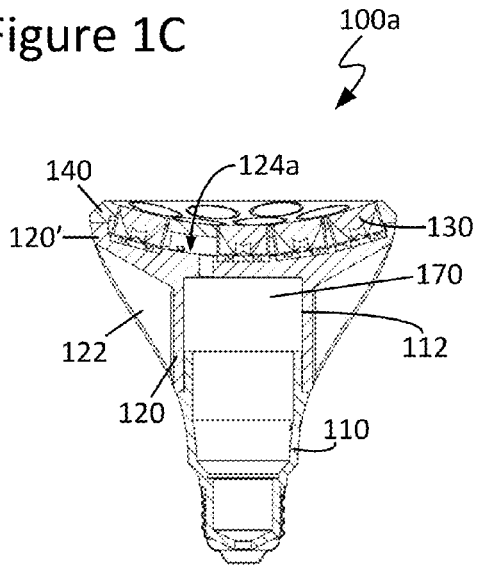
FIG. 1C is a cross-sectional view of the lamp of FIG. 1B taken along line A-A therein.
Figure 2A:
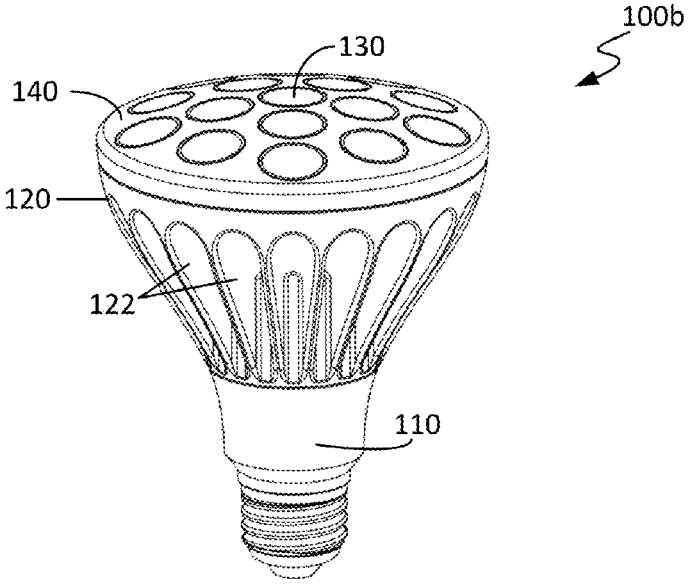
FIG. 2A is a perspective view of a lamp configured in accordance with another embodiment of the present disclosure.
Figure 2B:
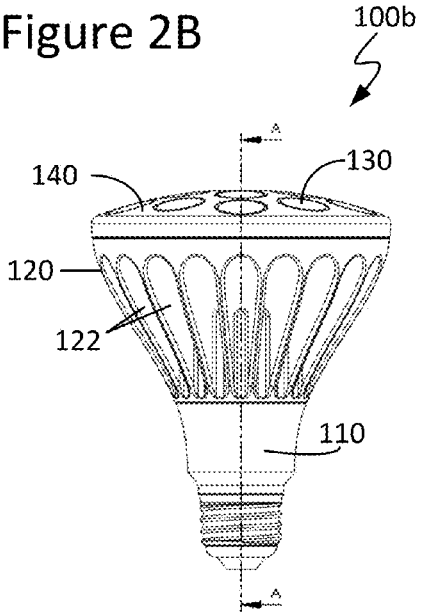
FIG. 2B is a side view of the lamp of FIG. 2A.
Figure 2C:
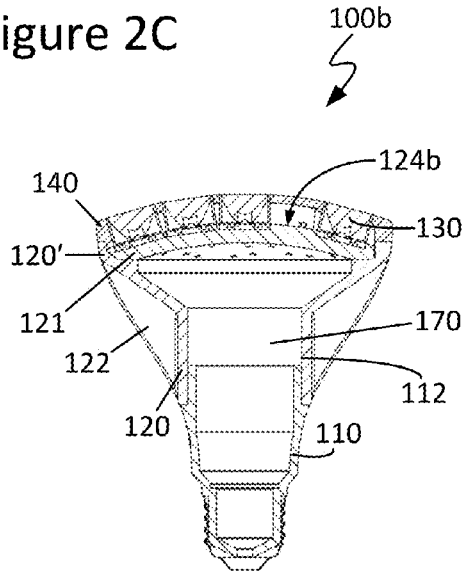
FIG. 2C is a cross-sectional view of the lamp of FIG. 2B taken along line A-A therein.

FIGS. 1A-1C illustrate several views of a solid-state lamp 100*a* configured in accordance with an embodiment of the present disclosure. FIGS. 2A-2C illustrate several views of a solid-state lamp 100*b* configured in accordance with another embodiment of the present disclosure. For consistency and ease of understanding of the present disclosure, solid-state lamps 100*a* and 100*b* hereinafter may be collectively referred to generally as a solid-state lamp 100, except where separately enumerated. As discussed herein, the configuration (e.g., geometry, fitting size, light source arrangement, etc.) of a given lamp 100 may be customized, as desired for a given target application or end-use, and in accordance with some embodiments, may be compatible for retrofitting sockets/enclosures typically used in existing luminaire structures. Thus, in a general sense, lamp 100 may be considered a retrofit or other drop-in replacement lighting component, in accordance with some embodiments.

The base portion 110 of lamp 100 may be configured to engage a typical power socket and can have any of a wide range of configurations to that end. For instance, some example suitable configurations for base portion 110 include: a threaded lamp base including an electrical foot contact; a bi-pin, tri-pin, or other multi-pin lamp base; a twist-lock mount lamp base; and/or a bayonet connector lamp base. Also, base portion 110 may be of any standard and/or custom fitting size, as desired for a given target application or end-use. For example, in accordance with some embodiments, base portion 110 may be of a fitting size that is compatible for retrofitting sockets/enclosures typically used in luminaires, such as: MR16; PAR16; PAR20; PAR30; PAR38; BR30; BR40; and/or 4"-6" recessed kits. Other suitable configurations for base portion 110 will depend on a given application and will be apparent in light of this disclosure.

In some embodiments, base portion 110 optionally may have an internal cavity 112 formed therein. When included, internal cavity 112 may be configured, for example, to house electronic componentry/devices that may be associated with lamp 100, and the particular dimensions of optional internal cavity 112 can be customized to such end. As discussed below, driver 170 of lamp 100, for example, may be housed within internal cavity 112, in accordance with some embodiments.

The heat sink portion 120 of lamp 100 may be configured to facilitate heat dissipation for the one or more solid-state light sources 130 (discussed below) thereof, and in some embodiments may include a plurality of fin-like features 122 to that end. In some cases, the fins 122 and heat sink portion 120 may be formed as a unitary component; that is, fins 122 and heat sink portion 120 may be formed from a single (e.g., monolithic) piece of material to provide a single, continuous heat sink component. In some other cases, however, the fins 122 and heat sink portion 120 may be separate elements that are assembled with one another; that is, fins 122 and heat sink portion 120 may be attached to or otherwise assembled with one another using any suitable means, such as a snap-on fit, a friction fit, a screw fit, welding, adhesive, fastener(s), or any other suitable technique for joining fins 122 and heat sink portion 120, as will be apparent in light of this disclosure. To facilitate heat dissipation, heat sink portion 120 may be constructed from any suitable thermally conductive material, such as, for example: aluminum (Al); copper (Cu); brass; steel; a composite and/or polymer (e.g., ceramics, plastics, etc.) doped with thermally conductive material; and/or a combination of any one or more thereof. Other suitable materials and configurations for heat sink portion 120 will depend on a given application and will be apparent in light of this disclosure.

In some cases, heat sink portion 120 and body portion 110 may be separate pieces that may be operatively coupled with one another in forming lamp 100. That is, in some embodiments, body portion 110 and heat sink portion 120 may be attached to or otherwise assembled with one another using any of the example techniques/means discussed above, for instance, with respect to fins 122. In some other cases, however, heat sink portion 120 and body portion 110 may be formed as a unitary component. That is, in some embodiments, body portion 110 and heat sink portion 120 may be formed from a single (e.g., monolithic) piece of material to provide a single, continuous component. Numerous suitable configurations will be apparent in light of this disclosure.

In accordance with some embodiments, a given lamp 100 may include one or more solid-state light sources 130 arranged therein. FIG. 3 is a cross-sectional view of a solid-state light source 130 configured in accordance with an embodiment of the present disclosure. A given solid-state light source 130 may include one or more solid-state emitters 132 configured to emit wavelength(s) from any spectral band (e.g., visible, infrared, ultraviolet, etc.), as desired for a given target application or end-use. In some embodiments, a given solid-state emitter 132 may be individually addressable. In some embodiments, a given solid-state emitter 132 may be addressable in one or more groupings. Some example suitable solid-state emitters 132 for use in lamp 100 include: a light-emitting diode (LED); an organic light-emitting diode (OLED); a polymer light-emitting diode (PLED); and/or any other suitable semiconductor light source, as will be apparent in light of this disclosure. In some embodiments, a given solid-state emitter 132 may be configured for emissions of a single correlated color temperature (CCT) (e.g., a white light-emitting semiconductor light source). In some other embodiments, however, a given solid-state emitter 132 may be configured for color-tunable emissions. For instance, a given solid-state emitter 132 may be a multi-color (e.g., bi-color, tri-color, etc.) semiconductor light source configured for RGB, RGBY, RGBW, WW, or other desired emissions. In some embodiments, a given solid-state emitter 132 may be configured as a high-brightness semiconductor light source. In some cases, a given solid-state emitter 132 may be provided with a combination of any one or more of the aforementioned example emissions capabilities. Other suitable configurations for the one or more solid-state emitters 132 of a given solid-state light source 130 of lamp 100 will depend on a given application and will be apparent in light of this disclosure.

The one or more solid-state emitters 132 of a given solid-state light source 130 can be packaged or non-packaged, as desired, and in some cases may be populated on a printed circuit board (PCB) 134 or other suitable intermediate/substrate. In some embodiments, all (or some sub-set) of the solid-state emitters 132 of a given solid-state light source 130 may have their own associated PCBs 134. In some such cases, all (or some sub-set) of those PCBs 134 may be interconnected with one another using any suitable interconnection techniques (e.g., interconnecting wires), as will be apparent in light of this disclosure. Also, in accordance with some embodiments, all (or some sub-set) of those PCBs 134 may be arranged to conform to (or otherwise map) the contour of underlying mounting surface 124 (e.g., concave mounting surface 124*a*; convex mounting surface 124*b*), discussed below. In some embodiments, all (or some sub-set) of the solid-state emitters 132 of a given solid-state light source 130 may share a single PCB 134. In some such cases, the shared PCB 134 may be folded, faceted, articulated, or otherwise configured to conform to (or otherwise generally map) the contour of underlying mounting surface 124 (e.g., concave mounting surface 124*a*; convex mounting surface 124*b*). Also, as will be appreciated in light of this disclosure, a given PCB 134 may include other componentry (e.g., resistors, transistors, integrated circuits, etc.) populated thereon in addition to one or more solid-state emitters 132, in accordance with some embodiments. In some cases, the power and/or control connections for a given solid-state emitter 132 may be routed from a given PCB 134 to a driver 170 (and/or other devices/componentry) housed, for example, within internal cavity 112 of base portion 110. Other suitable configurations for the one or more PCBs 134 of a given lamp 100 will depend on a given application and will be apparent in light of this disclosure.

As can be seen further from FIG. 3, a given solid-state light source 130 may include one or more optics 136, in accordance with some embodiments. Optics 136 may be configured, in accordance with some embodiments, to transmit the one or more wavelengths of interest of the light (e.g., visible, ultraviolet, infrared, etc.) emitted by solid-state emitter(s) 132 optically coupled therewith. To that end, optics 136 may include an optical structure (e.g., a lens, window, dome, etc.) formed from any of a wide range of optical materials, such as, for example: a polymer, such as poly(methyl methacrylate) (PMMA) or polycarbonate; a ceramic, such as sapphire ($Al_2O_3$) or yttrium aluminum garnet (YAG); a glass; and/or a combination of any one or more thereof. In some instances, optics 136 may include optical features, such as, for example: an anti-reflective (AR) coating; a reflector; a diffuser; a polarizer; a brightness enhancer; and/or a phosphor material (e.g., which converts light received thereby to light of a different wavelength). The size, geometry, and/or optical transmission characteristics of optics 136 may be customized, as desired for a given target application or end-use.

In some embodiments, each solid-state light source 130 of lamp 100 may have its own optics 136 associated therewith, whereas in some other embodiments, multiple light sources 130 may share one or more optics 136. In some embodiments, optics 136 may include one or more focusing optics. In some example cases, optics 136 may be a single optical structure (e.g., an injection-molded window, lens, dome, etc.) optically coupled with multiple solid-state light sources 130 of a lamp 100. In some embodiments, the optics 136 of a given solid-state light source 130 may be attached to or otherwise integrated with an optional cover portion 150 and/or (2) additional optional optics 160, each discussed below.

In some cases, optics 136 may include electronically controllable componentry that may be used, in accordance with some embodiments, to modify the output of a host solid-state light source 130 (and thus modify the output of host lamp 100). For example, optics 136 may include one or more electro-optic tunable lenses or other suitable focusing optics that can be electronically adjusted to vary the angle, direction, and/or size (among other attributes) of the light beam output by a given solid-state emitter 132. In some other cases, optics 136 may include a Fresnel lens or other fixed optics, for example, to modify the output beam of a given solid-state light source 130. Other suitable types and configurations for the optics 136 of a given solid-state light source 130 will depend on a given application and will be apparent in light of this disclosure.

In accordance with some embodiments, the light source(s) 130 of lamp 100 may be electronically coupled with a driver 170. In some cases, driver 170 may be a multi-channel electronic driver configured, for example, for use in controlling one or more solid-state emitters 132 of a given lamp 100. For instance, in some embodiments, driver 170 may be configured to control the ON/OFF state, dimming level, color of emissions, correlated color temperature (CCT), and/or color saturation of a given solid-state emitter 132 (or grouping of emitters 132). To such ends, driver 170 may utilize any of a wide range of driving techniques, including, for example: (1) a pulse-width modulation (PWM) dimming protocol; (2) a current dimming protocol; (3) a triode for alternating current (TRIAC) dimming protocol; (4) a constant current reduction (CCR) dimming protocol; (5) a pulse-frequency modulation (PFM) dimming protocol; (6) a pulse-code modulation (PCM) dimming protocol; (7) a line voltage (mains) dimming protocol (e.g., dimmer is connected before input of driver 170 to adjust AC voltage to driver 170); and/or any other suitable lighting control/driving technique, as will be apparent in light of this disclosure. As previously noted, driver 170 may be housed by lamp 100 within internal cavity 112 of base portion 110, in some embodiments. Other suitable configurations for driver 170 will depend on a given application and will be apparent in light of this disclosure.

The quantity and arrangement of solid-state light sources 130 utilized in a given lamp 100 may be customized, as desired for a given target application or end-use, and in some instances may be selected based on the dimensions and/or geometry of the internal mounting surface(s) provided within lamp 100. A given solid-state light source 130 may be mounted to mounting surface 124, for example, via a thermally conductive adhesive or any other suitable coupling means, as will be apparent in light of this disclosure. In accordance with some embodiments, one or more solid-state light sources 130 can be arranged over a concave mounting surface 124*a*, such as can be seen with respect to concave solid-state lamp 100*a*, for example, shown in FIGS. 1A-1C. Conversely, in accordance with some other embodiments, one or more solid-state light sources 130 can be arranged over a convex mounting surface 124*b*, such as can be seen with respect to convex solid-state lamp 100*b*, for example, shown in FIGS. 2A-2C. For consistency and ease of understanding of the present disclosure, concave mounting surface 124*a* and convex mounting surface 124*b* hereinafter may be collectively referred to generally as mounting surface 124, except where separately enumerated.

In accordance with some embodiments, the mounting surface 124 of lamp 100 may be provided, in part or in whole, by heat sink portion 120. For instance, in some embodiments, an upper portion of heat sink portion 120 may be configured to provide a generally curved/non-planar concave mounting surface 124*a* (e.g., such as can be seen in FIG. 1C). In some other embodiments, an upper portion of heat sink portion 120 may be configured to provide a generally curved/non-planar convex mounting surface 124*b*.

It should be noted, however, that the present disclosure is not so limited, as in accordance with some other embodiments, the mounting surface 124 of lamp 100 may be provided, in part or in whole, by an optional mounting interface 121 disposed over and/or thermally coupled with heat sink portion 120 (e.g., such as can be seen in FIG. 2C). When included, optional mounting interface 121 may be constructed from any of the example materials discussed above, for instance, with respect to heat sink portion 120. In an example case, optional mounting interface 121 may be a pre-formed metal sheet that is physically and/or thermally coupled with heat sink portion 120. In some embodiments, mounting interface 121 may be a parabolic aluminized reflector (PAR). In some other embodiments, mounting interface 121 may be a bulged reflector (BR). In some still other embodiments, mounting interface 121 may be a multi-faceted reflector (MR). Other suitable configurations for optional mounting interface 121 will depend on a given application and will be apparent in light of this disclosure.

The geometry of mounting surface 124, whether provided by heat sink portion 120 or an optional mounting interface 121, may be customized, as desired for a given target application or end-use. In some embodiments, mounting surface 124 may be generally arcuate or sub-hemispherical in shape. In some other embodiments, mounting surface 124 may be generally hemispherical or oblate hemispherical in shape. In some other embodiments, mounting surface 124 may be hyper-hemispherical in shape. In some such cases, mounting of solid-state light sources 130 on a hyper-hemispherical mounting surface 124 may allow for directing light into higher angles and/or coverage of a larger space. In some instances, mounting surface 124 may provide a non-planar surface of generally smooth contour, while in some other instances, mounting surface 124 may provide a non-planar surface of generally non-smooth contour (e.g., faceted, angled, or otherwise articulated). Other suitable geometries for mounting surface 124 (e.g., concave mounting surface 124*a* for lamp 100*a*; convex mounting surface 124*b* for lamp 100*b*) will depend on a given application and will be apparent in light of this disclosure.

In some instances, the quantity and arrangement of solid-state light sources 130 may be selected, for example, based on the size of the socket and/or enclosure that is to receive lamp 100. For instance, consider FIG. 4A, which is a plan view of a solid-state lamp 100 configured for retrofitting a MR16 socket/enclosure, in accordance with an example embodiment of the present disclosure. As can be seen in this depicted example case, the diameter of mounting surface 124 may be about 2 inches, the diameter of each solid-state light source 130 may be about ⅝ (0.625) inch, and the distance from the center of a given solid-state light source 130 to the edge of mounting surface 124 may be about ⅜ (0.375) inch.

FIG. 4B is a plan view of a solid-state lamp 100 configured for retrofitting a MR16 socket/enclosure, in accordance with another example embodiment of the present disclosure. As can be seen in this depicted example case, the diameter of mounting surface 124 may be about 2 inches, the diameter of each solid-state light source 130 may be about ⅝ (0.625) inch, and the distance from the center of a given solid-state light source 130 to the edge of mounting surface 124 may be about ⅝ (0.625) inch.

FIG. 4C is a plan view of a solid-state lamp 100 configured for retrofitting a PAR30 socket/enclosure, in accordance with another example embodiment of the present disclosure. As can be seen in this depicted example case, the diameter of mounting surface 124 may be about 3¾ (3.75) inches, the diameter of each solid-state light source 130 may be about ⅝ (0.625) inch, the radial distance of a first (inner) concentric arrangement of solid-state light sources 130 from the center of mounting surface 124 may be about ¾ (0.75) inch, and the radial distance of a second (outer) concentric arrangement of solid-state light source 130 from the center of mounting surface 124 may be about 1⅜ (1.375) inch. Also, this example lamp 100 may include a medium screw base portion 110, configured as typically done.

Figure 5:
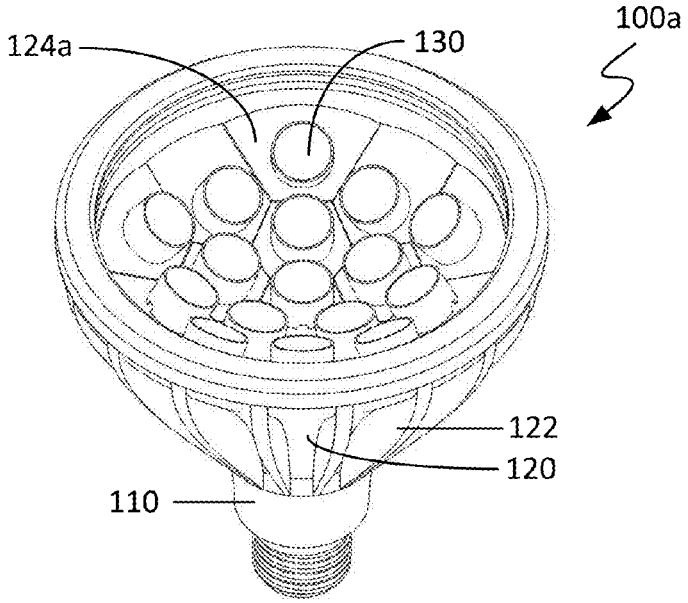
FIG. 5 is a perspective view of a concave solid-state lamp configured for retrofitting a PAR30 socket/enclosure, in accordance with another embodiment of the present disclosure.
Figure 6:
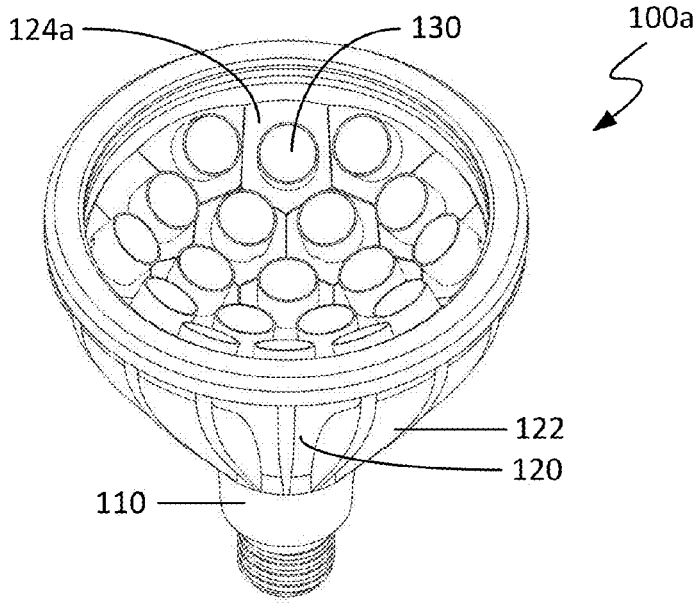
FIG. 6 is a perspective view of a concave solid-state lamp configured for retrofitting a BR40 socket/enclosure, in accordance with another embodiment of the present disclosure.

FIG. 5 is a perspective view of a concave solid-state lamp 100*a* configured for retrofitting a PAR30 socket/enclosure, in accordance with another embodiment of the present disclosure. As can be seen in this depicted example case, the illustrated lamp 100*a* includes sixteen (16) solid-state light sources 130 arranged over a concave mounting surface 124*a* configured, in accordance with an embodiment, as a parabolic aluminized reflector (PAR). FIG. 6 is a perspective view of a concave solid-state lamp 100*a* configured for retrofitting a BR40 socket/enclosure, in accordance with another embodiment of the present disclosure. As can be seen in this depicted example case, the illustrated lamp 100*a* includes nineteen (19) solid-state light sources 130 arranged over a concave mounting surface 124*a* configured, in accordance with an embodiment, as a bulged reflector (BR). In some cases, the PAR-type or BR-type concave mounting surface 124*a* may be formed, at least in part, from heat sink portion 120, whereas in some other cases, it may be formed, at least in part, from an optionally included mounting interface (e.g., such as a mounting interface 121, discussed above). It should be noted, however, that the present disclosure is not so limited only to mounting surfaces 124 configured as a PAR or BR, as in accordance with some other embodiments, a given mounting surface 124 may be configured, for example, as a multi-faceted reflector (MR) or any other standard and/or custom reflector, as will be apparent in light of this disclosure. Also, the quantities and arrangements of solid-state light sources 130 of a given solid-state lamp 100 may be customized as desired for a given target application or end-use and are not intended to be limited only to the specific example configurations depicted in FIGS. 5 and 6. Furthermore, the base portion 110 may be customized as desired, and in some cases may be, for instance, a medium Edison-type screw base configured as typically done. Numerous configurations will be apparent in light of this disclosure.

Figure 7A:
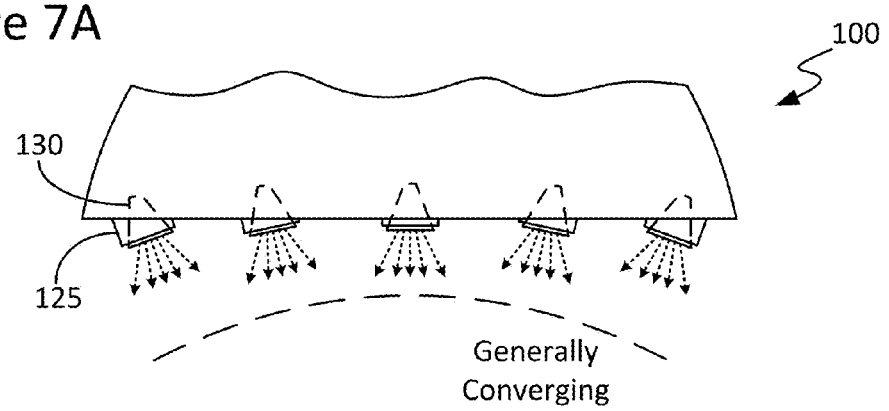
FIGS. 7A-7C illustrate several example solid-state lamps including example arrangements of optional pre-positioning blocks, in accordance with some embodiments of the present disclosure.
Figure 7B:
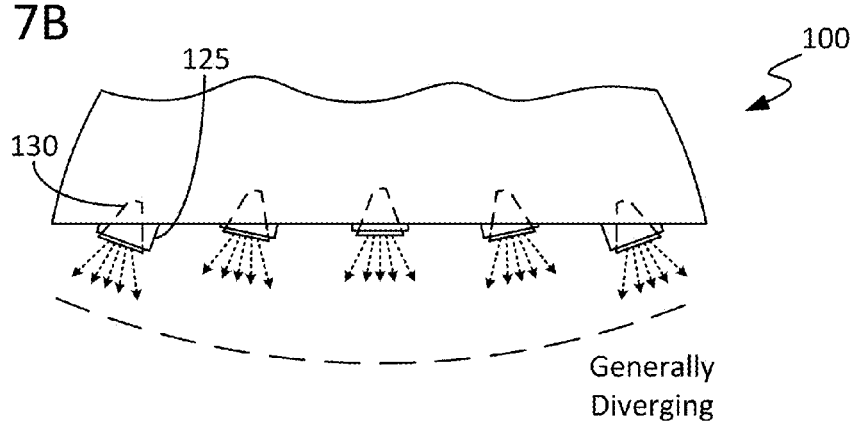
Figure 7C:
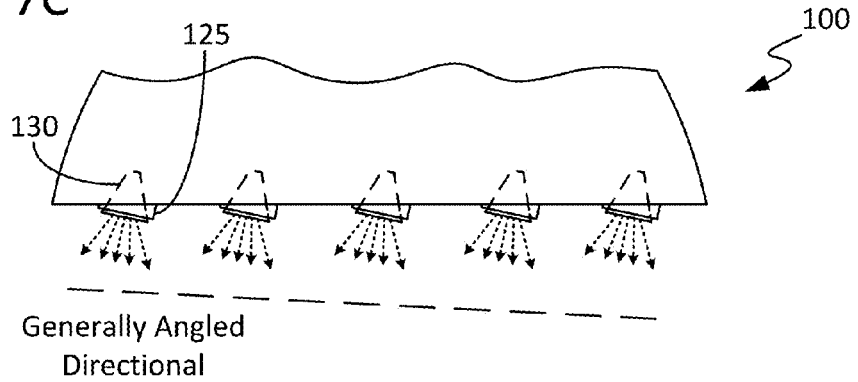

FIGS. 7A-7C illustrate several example lamps 100 including example arrangements of optional pre-positioning blocks 125, in accordance with some embodiments of the present disclosure. When optionally included, a given pre-positioning block 125 may be configured, for example, to facilitate directional aiming of a solid-state light source 130 mounted thereon. To that end, a given optional pre-positioning block 125 may be provided with any desired surface topography (e.g., stepped, curved, faceted, etc.) and may be oriented at any desired inclination/declination angle. Also, when included, a given pre-positioning block 125 may be physically and/or thermally coupled, for example, with the heat sink portion 120 of lamp 100, in accordance with some embodiments. Furthermore, a given pre-positioning block 125 may be constructed from any of the example materials discussed above, for instance, with respect to heat sink portion 120.

The quantity and arrangement of pre-positioning blocks 125, when optionally included, can be customized. For example, in some cases, a given lamp 100 optionally may include a converging arrangement of pre-positioning blocks 125, such as is generally illustrated in FIG. 7A. In some other cases, a diverging arrangement of pre-positioning blocks 125 may be provided, such as is generally illustrated in FIG. 7B. In some still other cases, an offset (e.g., skewed or otherwise angled) arrangement pre-positioning block 125, such as is generally illustrated in FIG. 7C. Other suitable configurations for a given optional pre-positioning block 125 will depend on a given application and will be apparent in light of this disclosure.

Returning to FIGS. 1A-1C and 2A-2C, lamp 100 optionally may include a face plate portion 140, in accordance with some embodiments. When included, optional face plate portion 140 may be constructed from any of the example materials discussed above, for instance, with respect to heat sink portion 120 and may be configured to interface with one or more solid-state light sources 130, as typically done. In some embodiments, face plate portion 140 may be configured with a contour that is substantially similar to that of underlying mounting surface 124. For instance, in some embodiments, face plate portion 140 may have a generally concave contour to complement an underlying concave mounting surface 124*a*, such as can be seen with lamp 100*a* in FIG. 1A. In some other embodiments, however, face plate portion 140 may have a generally convex contour to complement an underlying convex mounting surface 124*b*, such as can be seen with lamp 100*b* in FIG. 2A. In some still other embodiments, face plate portion 140 may be provided with a custom contour or a given degree of planarity, as desired for a given target application or end-use. Numerous suitable configurations will be apparent in light of this disclosure.

Figure 8:
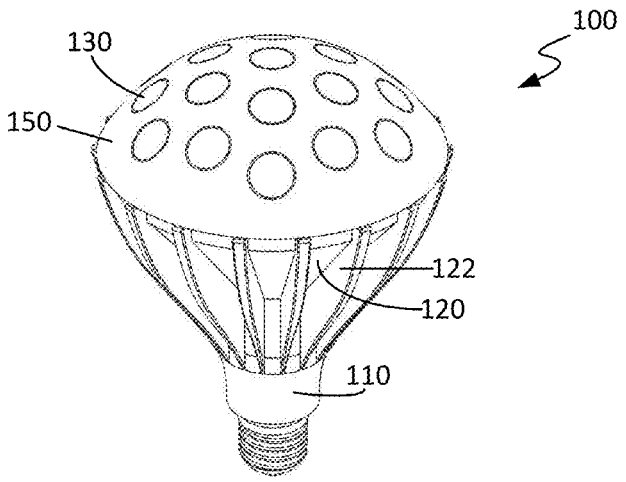
FIG. 8 illustrates a solid-state lamp optionally including a cover portion, in accordance with an embodiment of the present disclosure.
Figure 9A:
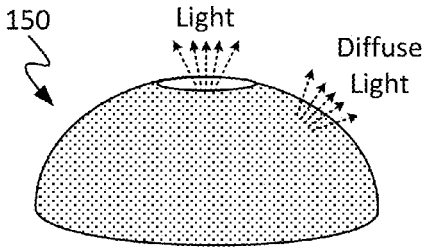
FIG. 9A-9D illustrate several example cover portions configured in accordance with some embodiments of the present disclosure.
Figure 9B:
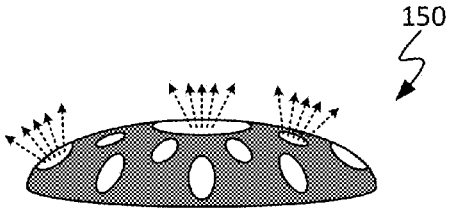
Figure 9C:
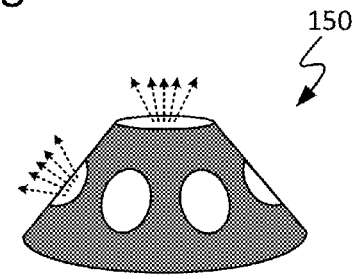
Figure 9D:
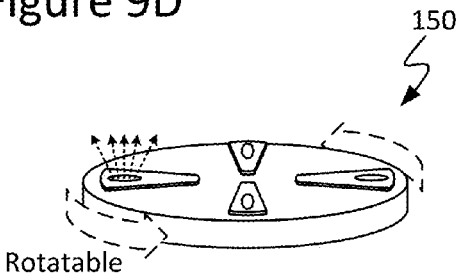

FIG. 8 illustrates a lamp 100 optionally including a cover portion 150, in accordance with an embodiment of the present disclosure. Optional cover portion 150 may have any of a wide range of configurations. For instance, optional cover portion 150 may be constructed from any suitable material (e.g., plastic, acrylic, polycarbonate, etc.) having any desired degree of optical transparency, as will be apparent in light of this disclosure. Also, the size and/or geometry of cover portion 150 may be customized. For example, consider FIG. 9A-9D, which illustrate several example cover portions 150 configured in accordance with some embodiments of the present disclosure. In some embodiments, cover portion 150 may be generally dome-shaped or cone-shaped. In some embodiments, cover portion 150 may include one or more openings, of any desired dimensions and geometry, through which light may pass freely. In some embodiments, the body of cover portion 150 may be formed from a material that facilitates diffusion of light passing therethrough. In some embodiments, cover portion 150 may be configured to rotate partially and/or fully in one or more directions. Numerous suitable configurations for optional cover portion 150 will be apparent in light of this disclosure.

Figure 10:
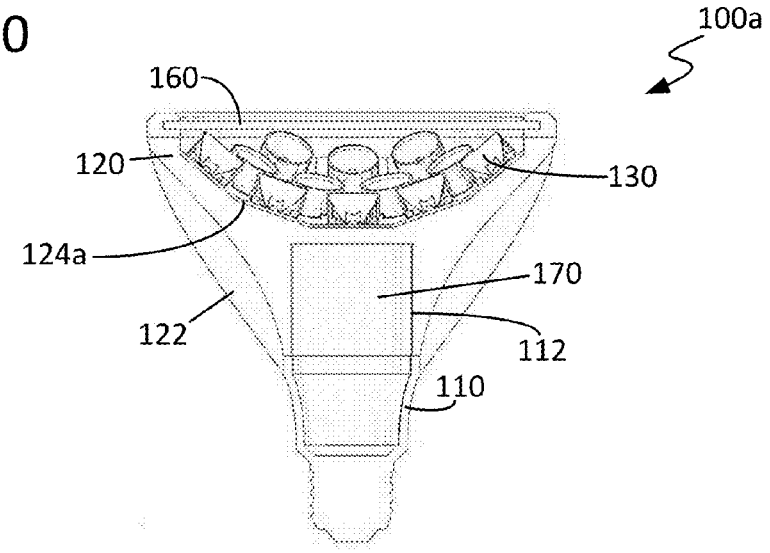
FIG. 10 illustrates a cross-sectional view of a solid-state lamp optionally including optics, in accordance with an embodiment of the present disclosure.

FIG. 10 illustrates a cross-sectional view of a concave lamp 100*a* optionally including optics 160, in accordance with an embodiment of the present disclosure. It should be noted, however, that the present disclosure is not so limited to inclusion of optional optics 160 only in the context of concave lamp 100*a*, as in accordance with some other embodiments, a convex lamp 100*b* optionally may be configured to host one or more optics 160. When included, optics 160 may be configured, in accordance with some embodiments, to transmit the one or more wavelengths of interest of the light (e.g., visible, ultraviolet, infrared, etc.) emitted by associated solid-state light source(s) 130. To that end, optics 160 may include an optical structure (e.g., a lens, window, dome, etc.) formed from any of the example materials discussed above, for instance, with respect to optics 136. In some instances, optics 160 may include optical features, such as, for example: an anti-reflective (AR) coating; a reflector; a diffuser; a polarizer; a brightness enhancer; and/or a phosphor material (e.g., which converts light received thereby to light of a different wavelength). In some embodiments, optics 160 may include one or more focusing optics. In some embodiments, lamp 100 may be configured such that one or more of the light beams produced by the solid-state light source(s) 130 of lamp 100 pass through a focal point generally located within optics 160. In some cases, optics 160 may include electronically controllable componentry that may be used, in accordance with some embodiments, to modify the output of the solid-state light source(s) 130 of a given lamp 100. For example, optics 160 may include one or more electro-optic tunable lenses or other suitable focusing optics that can be electronically adjusted to vary the angle, direction, and/or size (among other attributes) of the light beam output by a given solid-state light source 130. In some cases, such electro-optic tunable componentry may be utilized to narrow or widen accumulated light distribution, thereby contributing to varying the beam angle, beam direction, beam distribution, and/or beam size (among other attributes) of the light beam output by lamp 100. In some other cases, optics 160 may include a Fresnel lens or other fixed optics, for example, to modify the output beam of a given solid-state light source 130.

Figure 11A:
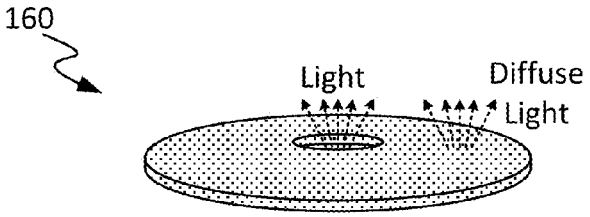
FIGS. 11A-11B illustrate several example optics configured in accordance with some embodiments of the present disclosure.
Figure 11B:
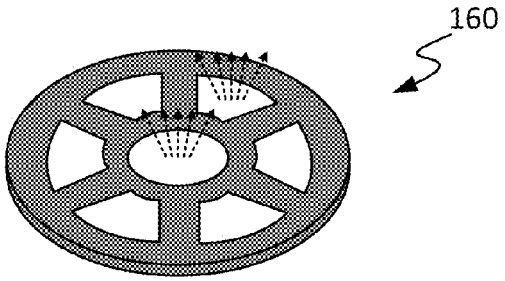

The size, geometry, and transparency of optics 160 may be customized, as desired for a given target application or end-use. For example, consider FIGS. 11A-11B, which illustrate several example optics 160 configured in accordance with some embodiments of the present disclosure. In some embodiments, optics 160 may be generally planar or otherwise disc-shaped. In some embodiments, optics 160 may include one or more openings, of any desired dimensions and geometry, through which light may pass freely. In some embodiments, optics 160 may be formed from a material that facilitates diffusion of light passing therethrough. In some embodiments, optics 160 may be configured to rotate partially and/or fully in one or more directions. Other suitable types and configurations for the optics 160 that optionally may be hosted by lamp 100 will depend on a given application and will be apparent in light of this disclosure.

As will be appreciated in light of this disclosure, a given solid-state lamp 100 also may include or otherwise be operatively coupled with other circuitry/componentry, for example, which may be used in solid-state lamps and luminaires. For instance, lamp 100 may be configured to host or otherwise be operatively coupled with any of a wide range of electronic components, such as: (1) power conversion circuitry (e.g., electrical ballast circuitry to convert an AC signal into a DC signal at a desired current and voltage to power a given solid-state light source 130); (2) constant current/voltage driver componentry; (3) transmitter and/or receiver (e.g., transceiver) componentry; and/or (4) internal processing componentry. When included, such componentry may be mounted, for example, on one or more driver 170 boards and housed within lamp 100 (e.g., within internal cavity 112 of base portion 110), in accordance with some embodiments.

Example Installations

As previously discussed, solid-state lamp 100 may be configured, in accordance with some embodiments, for retrofitting sockets/enclosures typically used in existing luminaire structures. Thus, in a general sense, solid-state lamp 100 may be considered a retrofit or other drop-in replacement lighting component for use in existing lighting infrastructure, in accordance with some embodiments.

Figure 12A:
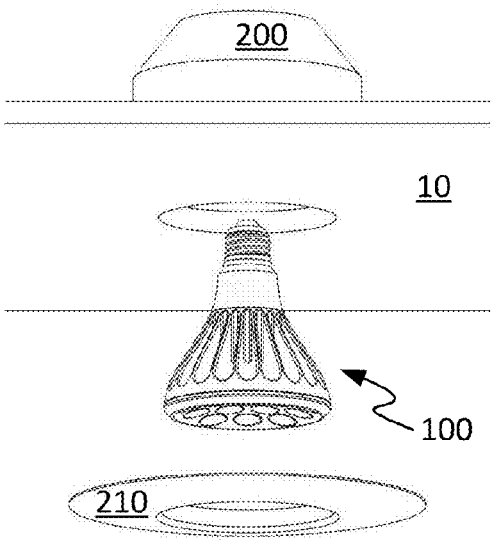
FIGS. 12A-12C illustrate installation of a solid-state lamp within an example luminaire, in accordance with some embodiments of the present disclosure.
Figure 12B:
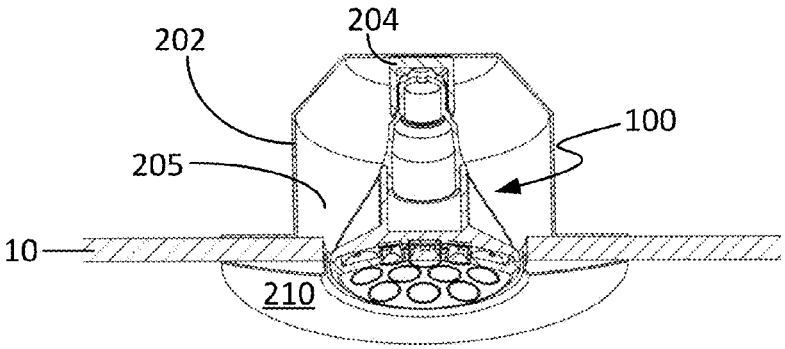
Figure 12C:
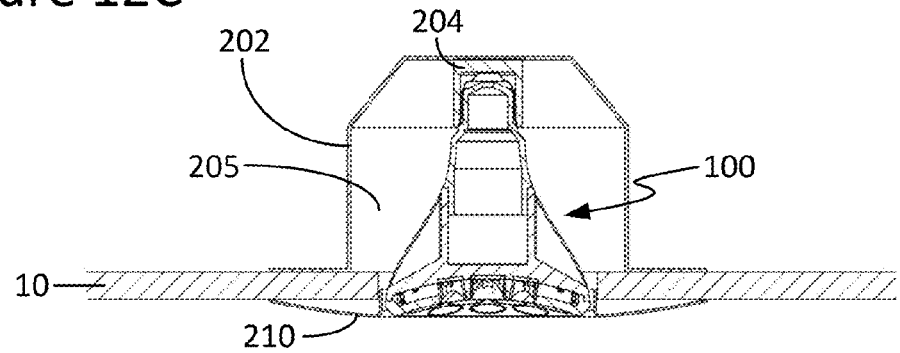

FIGS. 12A-12C illustrate installation of a solid-state lamp 100 within an example luminaire 200, in accordance with some embodiments of the present disclosure. As can be seen from these figures, example luminaire 200 includes a housing 202 having a hollow space therein which defines a plenum 205 and a socket 204 disposed therein. Socket 204 may be of any standard and/or custom fitting size, as desired for a given target application or end-use, and lamp 100 may be configured to draw power from socket 204, as typically done. In accordance with some embodiments, luminaire 200 may be configured to receive a lamp 100 of any of a wide range of formats, including, for example: MR16; PAR16; PAR20; PAR30; PAR38; BR30; BR40; and/or 4"-6" recessed kits. In some cases, a bezel 210 (e.g., a trim, collar, baffle, etc.) optionally may be utilized with luminaire 200.

In some embodiments, luminaire 200 may be configured to be mounted or otherwise fixed to a mounting surface 10 in a temporary or permanent manner. In some cases, luminaire 200 may be configured to be mounted as a recessed lighting fixture (e.g., as generally illustrated in FIGS. 12A-12C), whereas in some other cases, luminaire 200 may be configured as a pendant-type fixture, a sconce-type fixture, or other lighting fixture which may be suspended or otherwise extended from a given mounting surface 10. Some example suitable mounting surfaces 10 for luminaire 200 include ceilings, walls, floors, and/or steps. In some instances, mounting surface 10 may be a drop ceiling tile (e.g., having an area of about 2 ft.×2 ft., 2 ft.×4 ft., 4 ft.×4 ft., etc.) for installment in a drop ceiling grid. However, it should be noted that luminaire 200 need not be configured to be mounted on a mounting surface 10, as in some other embodiments it may be configured as a free-standing or otherwise portable lighting device, such as a desk lamp or a torchière lamp, for example. Numerous suitable configurations for luminaire 200 will be apparent in light of this disclosure.

Figure 13A:
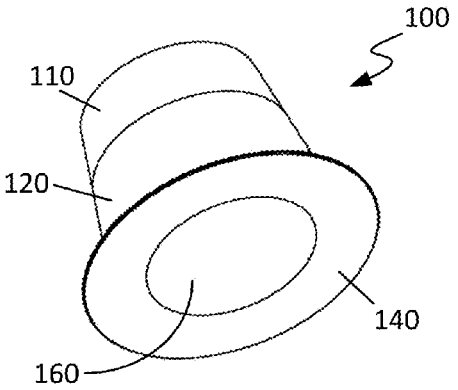
FIG. 13A is a perspective view of a solid-state lamp configured in accordance with another embodiment of the present disclosure.
Figure 13B:
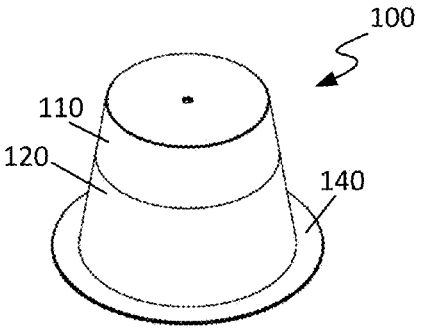
FIG. 13B is another perspective view of the solid-state lamp of FIG. 13A.
Figure 13C:
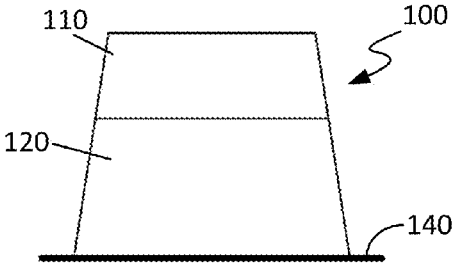
FIG. 13C is a side view of the solid-state lamp of FIG. 13A.
Figure 13D:
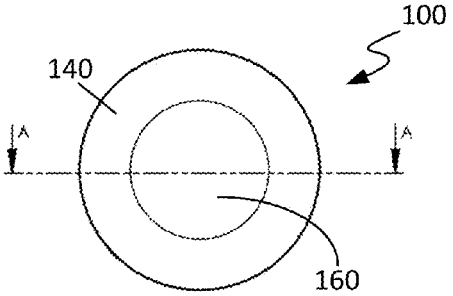
FIG. 13D is an end view of the solid-state lamp of FIG. 13A.
Figure 13E:
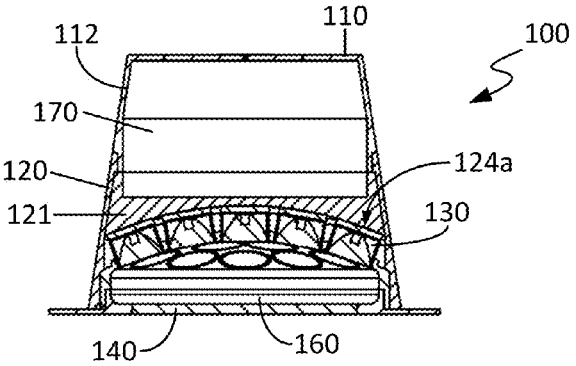
FIG. 13E is a cross-sectional view of the solid-state lamp of FIG. 13D taken along line A-A therein.

FIGS. 13A-13E illustrate several views of a solid-state lamp 100 configured in accordance with another embodiment of the present disclosure. As can be seen here, lamp 100 can be configured as a recessed can-style lamp that may be installed in any standard and/or custom recessed lighting housing, including, for example, an insulation contact (IC) housing, a non-IC housing, and/or an airtight (AT) housing. The one or more solid-state light sources 130 may be arranged over a concave mounting surface 124*a* (e.g., as generally shown in FIG. 13E) or may be arranged over a convex mounting surface 124*b*, as desired for a given target application or end-use. Mounting surface 124 may be provided, in part or in whole, by heat sink portion 120 and/or an optional mounting interface 121, in accordance with some embodiments. Optional optics 160 may be included, in some instances.

Figure 14:
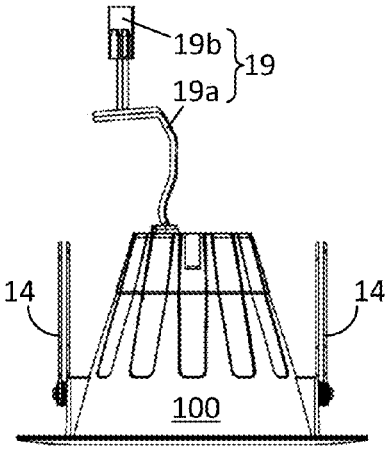
FIG. 14 is a side view of a solid-state lamp configured in accordance with another embodiment of the present disclosure.

FIG. 14 illustrates a side view of a solid-state lamp 100 configured in accordance with another embodiment of the present disclosure. As can be seen here, lamp 100 optionally may be coupled with an adjustable gimbal mount 14. Gimbal mount 14 may be configured, in accordance with some embodiments, to allow lamp 100: (1) to be adjusted in angle (e.g., pointing direction); and/or (2) to rotate partially and/or fully in one or more directions (e.g., with respect to a given mounting surface 10). Other suitable configurations for optional gimbal mount 14 will depend on a given application and will be apparent in light of this disclosure.

Figure 15:
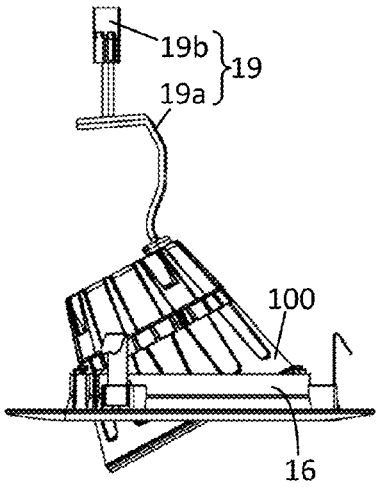
FIG. 15 is a side view of a solid-state lamp configured in accordance with another embodiment of the present disclosure.

FIG. 15 illustrates a side view of a solid-state lamp 100 configured in accordance with another embodiment of the present disclosure. As can be seen here, lamp 100 optionally may be coupled with an adapter 16 to facilitate retrofitting within a given luminaire 200, in some instances. In accordance with some embodiments, adapter 16 may be configured to be inserted within a given luminaire 200 to facilitate secure installation of a given lamp 100 therein. In some instances, adapter 16 may be configured to permit a lamp 100 to be adjusted in angle and/or to rotate within a given luminaire 200, as desired for a given target application or end-use. Optional adapter 16 may be formed from any of the example materials discussed above, for instance, with respect to heat sink portion 120, in accordance with some embodiments. The geometry and size of optional adapter 16 may be customized, as desired for a given target application or end-use.

As can be seen from FIGS. 14 and 15, lamp 100 may be provided with a power cable 19, in some embodiments. When provided, power cable 19 may include a wire portion 19*a* and a connector portion 19*b*. Wire portion 19*a* may be configured as typically done, and any standard and/or custom connector (e.g., push wire; blade; ring terminal; spade terminal; soldered; crimp-on; etc.) may be utilized as connector portion 19*b*, in accordance with some embodiments. When coupled with a power source, power cable 19 may serve to deliver power to lamp 100 for operation thereof, in accordance with some embodiments.

Figure 16A:
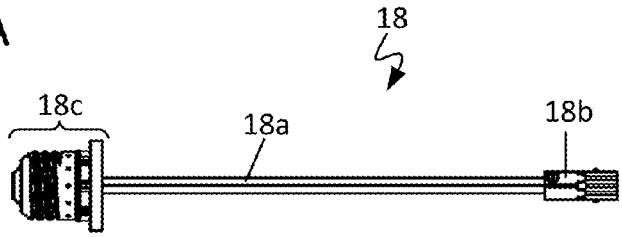
FIG. 16A is a top view of a power socket adapter for a solid-state lamp configured in accordance with an embodiment of the present disclosure.
Figure 16B:
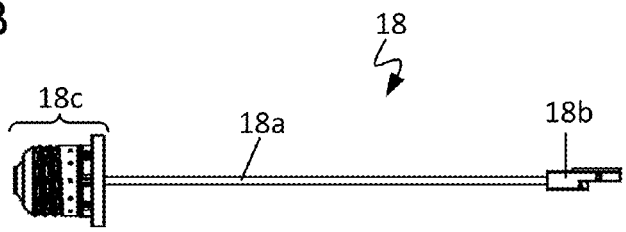
FIG. 16B is a side view of the power socket adapter of FIG. 16A.

FIGS. 16A-16B illustrate several views of an optional power socket adapter 18 configured in accordance with an embodiment of the present disclosure. As can be seen, optional power socket adapter 18 may include a wire portion 18*a*, a connector portion 18*b*, and a socket portion 18*c*. Wire portion 18*a* may be configured as typically done, and any standard and/or custom connector (e.g., push wire; blade; ring terminal; spade terminal; soldered; crimp-on; etc.) may be utilized as connector portion 18*b*, in accordance with some embodiments. Connector portion 18*b* may be configured, in some embodiments, to electronically couple with a correspondingly configured connector portion 19*b* of a power cable 19. Socket portion 18*c* may be configured, in accordance with some embodiments, to electronically couple with a standard and/or custom power socket. As will be appreciated in light of this disclosure, socket portion 18*c* may have any of the example configurations (e.g., contact type, fitting size, etc.) discussed above, for instance, with respect to base portion 110, in accordance with some embodiments. When coupled with a power socket, power socket adapter 18 and power cable 19 may serve to deliver power to lamp 100 for operation thereof, in accordance with some embodiments.

Output Control

As previously noted, the solid-state emitters 132 of lamp 100 may be individually addressable and/or addressable in one or more groupings, and thus can be electronically controlled individually and/or in conjunction with one another (e.g., as one or more groupings of emitters 132), for example, to provide highly adjustable light emissions from lamp 100, in accordance with some embodiments. To that end, lamp 100 may include or otherwise be communicatively coupled with one or more controllers 190, in accordance with some embodiments.

Figure 17A:
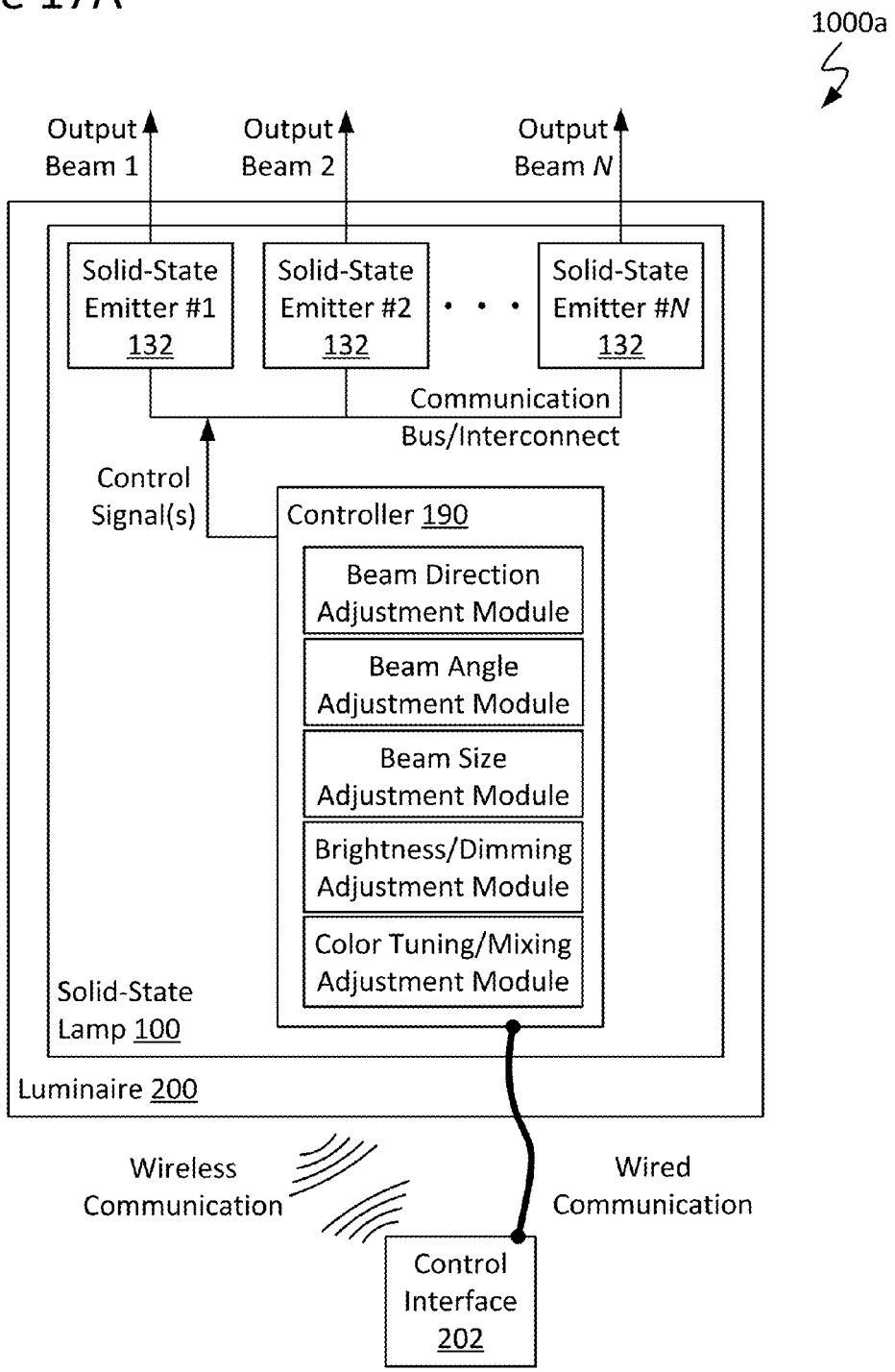
FIG. 17A is a block diagram of a lighting system configured in accordance with an embodiment of the present disclosure.

For example, consider FIG. 17A, which is a block diagram of a lighting system 1000*a* configured in accordance with an embodiment of the present disclosure. Here, a controller 190 is located in lamp 100 and operatively coupled (e.g., by a communication bus/interconnect) with the solid-state emitters 132 (1-N) of lamp 100. In some instances, a given controller 190 of solid-state lamp 100 may be populated, for example, on one or more PCBs 134. In this example case, controller 190 may output a control signal to any one or more of the solid-state emitters 132 and may do so, for example, based on wired and/or wireless input received from one or more control interfaces 202, discussed below. As a result, lamp 100 may be controlled in such a manner as to output any number of output beams (1-N), which may be varied in beam direction, beam angle, beam size, beam distribution, brightness/dimness, and/or color, as desired for a given target application or end-use.

Figure 17B:
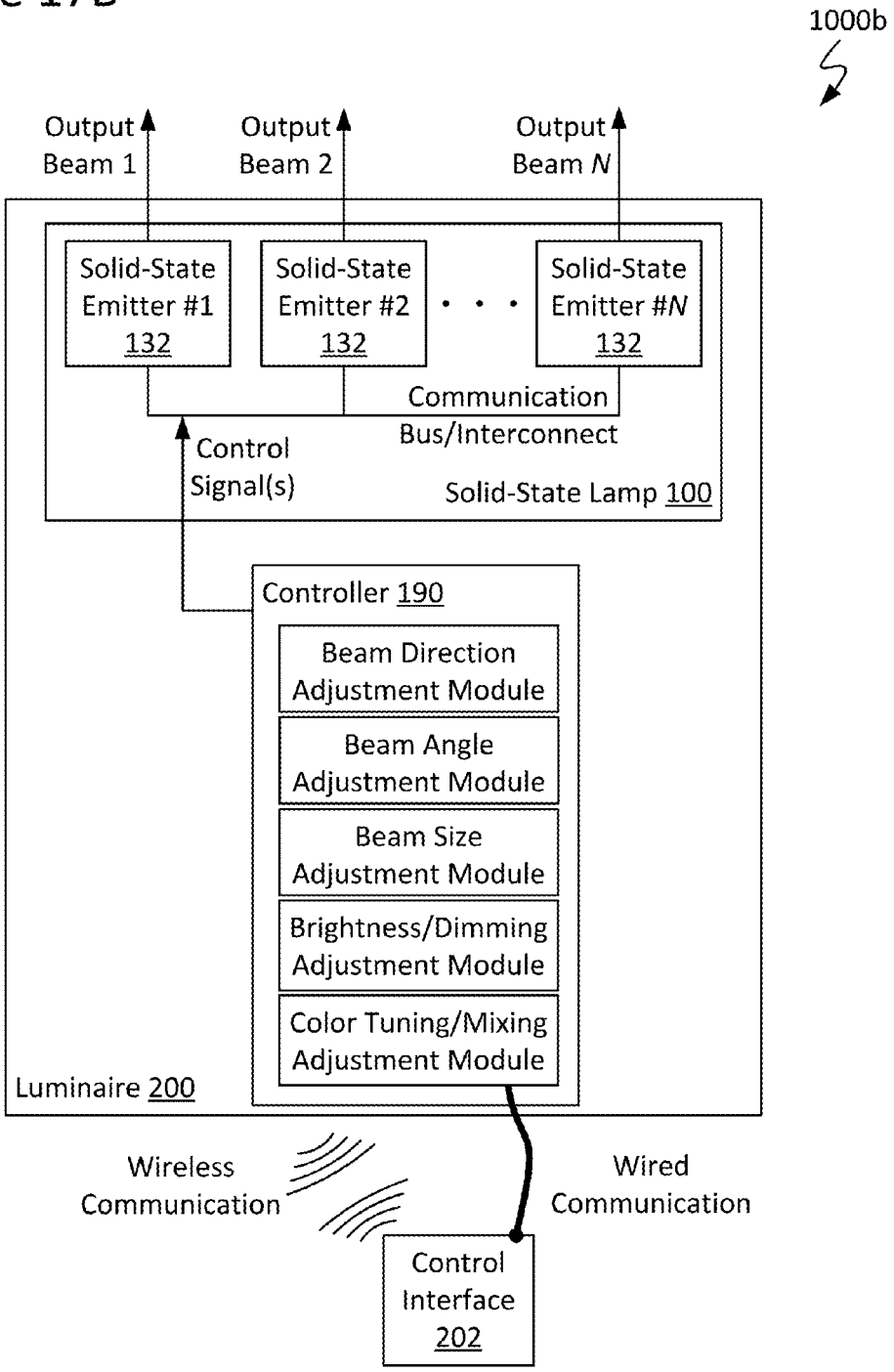
FIG. 17B is a block diagram of a lighting system configured in accordance with another embodiment of the present disclosure.

However, the present disclosure is not so limited. For instance, consider FIG. 17B, which is a block diagram of a lighting system 1000*b* configured in accordance with another embodiment of the present disclosure. Here, a controller 190 is located on-board luminaire 200 and operatively coupled (e.g., by a communication bus/interconnect) with the solid-state emitters 132 (1-N) of lamp 100. In this example case, a given controller 190 of solid-state lamp 100 may output a control signal to any one or more of the solid-state emitters 132 and may do so, for example, based on wired and/or wireless input received from one or more control interfaces 202, discussed below. As a result, lamp 100 may be controlled in such a manner as to output any number of output beams (1-N), which may be varied in beam direction, beam angle, beam size, beam distribution, brightness/dimness, and/or color, as desired for a given target application or end-use.

In accordance with some embodiments, a given controller 190 may host one or more lighting control modules and can be programmed or otherwise configured to output one or more control signals, for example, to adjust the operation of: (1) the one or more solid-state emitters 132 of a given solid-state lamp 100; (2) the optics 136 of a given solid-state light source 130; and/or (3) the optics 160 of a given solid-state lamp 100, when optionally included. For example, in some cases, a given controller 190 may be configured to output a control signal to control whether the beam is ON/OFF, as well as control the beam direction, beam angle, beam distribution, and/or beam diameter of the light emitted by a given solid-state light source 130. In some instances, a given controller 190 may be configured to output a control signal to control the intensity/brightness (e.g., dimming, brightening) of the light emitted by a given solid-state emitter 132. In some cases, a given controller 190 may be configured to output a control signal to control the color (e.g., mixing; tuning) of the light emitted by a given solid-state emitter 132. Thus, if a given solid-state lamp 100 includes two or more solid-state emitters 132 configured to emit light having different wavelengths, the control signal may be used to adjust the relative brightness of the different solid-state emitters 132 in order to change the mixed color output by that solid-state lamp 100. In some instances in which a given solid-state light source 130 is configured for multi-colored emissions, such a source 130 may be electronically controlled, in accordance with some embodiments, so as to adjust the color of light distributed at different angles and/or directions.

In accordance with some embodiments, a given controller 190 may utilize any of a wide range of wired and/or wireless digital communications protocols, including, for example: (1) a digital multiplexer (DMX) interface protocol; (2) a Wi-Fi protocol; (3) a Bluetooth protocol; (4) a digital addressable lighting interface (DALI) protocol; (5) a ZigBee protocol; (6) a KNX protocol; (7) an EnOcean protocol; (8) a TransferJet protocol; (9) an ultra-wideband (UWB) protocol; (10) a WiMAX protocol; (11) a high performance radio metropolitan area network (HiperMAN) protocol; (12) an infrared data association (IrDA) protocol; (13) a Li-Fi protocol; (14) an IPv6 over low power wireless personal area network (6LoWPAN) protocol; (15) a MyriaNed protocol; (16) a WirelessHART protocol; (17) a DASH7 protocol; (18) a near field communication (NFC) protocol; (19) a Wavenis protocol; (20) a RuBee protocol; (21) a Z-Wave protocol; (22) an Insteon protocol; (23) a ONE-NET protocol; (24) an X10 protocol; and/or (25) any other suitable communications protocol, wired and/or wireless, as will be apparent in light of this disclosure. In some still other cases, a given controller 190 may be configured as a terminal block or other pass-through such that a given control interface 202 (discussed below) is effectively coupled directly with the individual solid-state emitters 132 of lamp 100. Numerous suitable configurations will be apparent in light of this disclosure.

Figure 18:
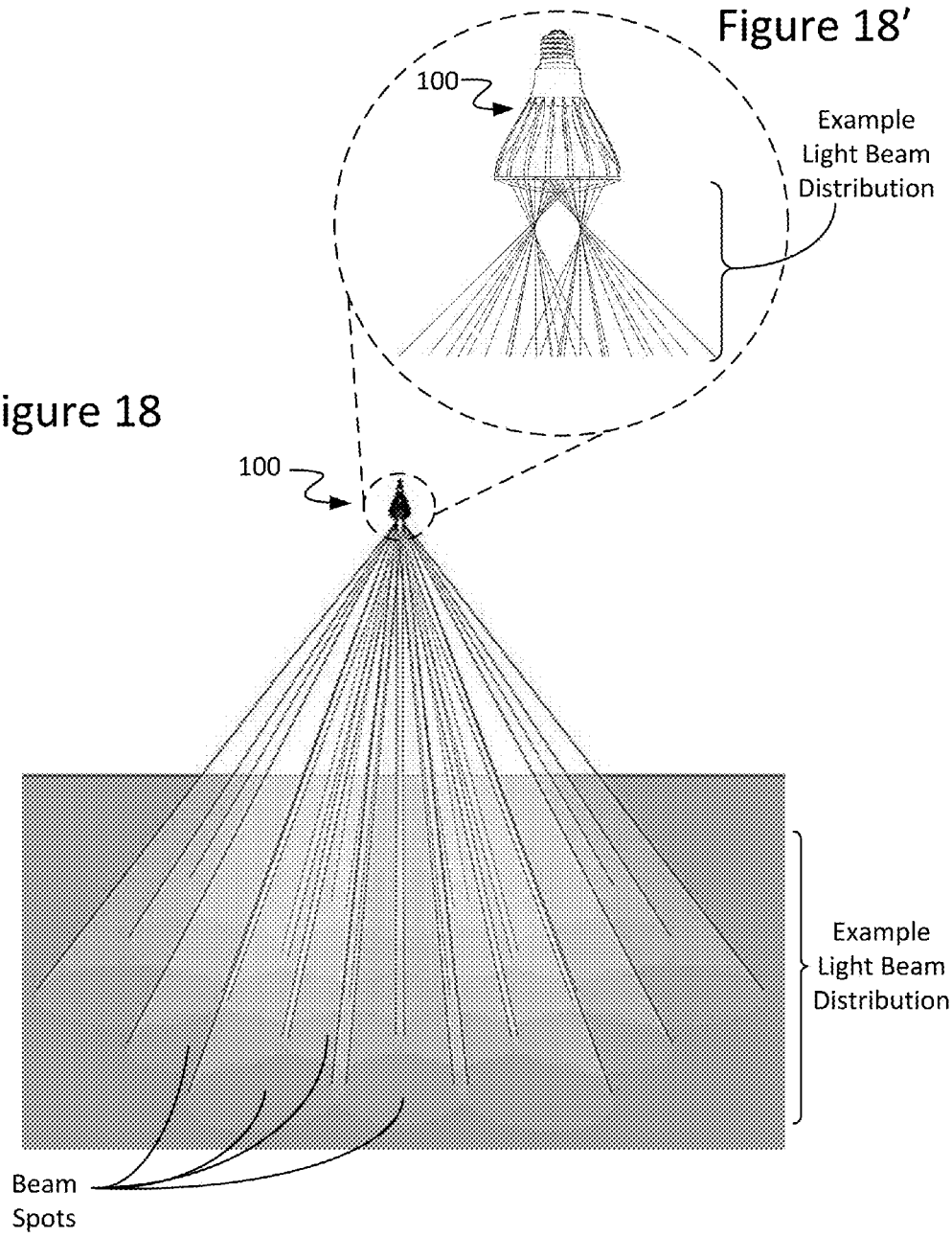
FIGS. 18 and 18' illustrate an example light beam distribution of a solid-state lamp configured in accordance with an embodiment of the present disclosure.
Figure 19A:
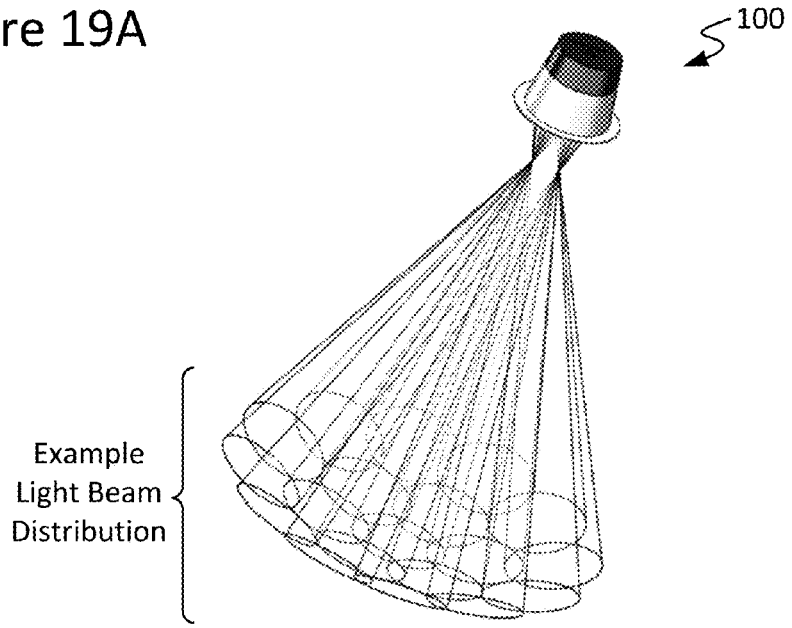
FIGS. 19A and 19B illustrate an example light beam distribution of a recessed can-type solid-state lamp configured in accordance with another embodiment of the present disclosure.
Figure 19B:
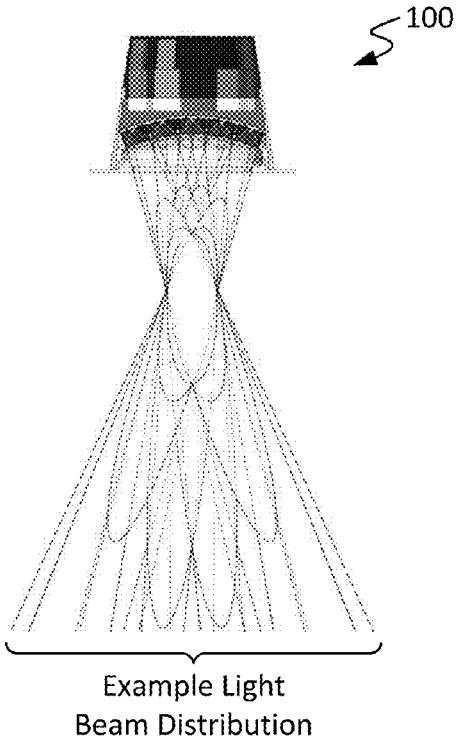

In accordance with some embodiments, the solid-state light sources 130 may be mounted over mounting surface 124 of lamp 100 such that their concave orientation (e.g., for a concave mounting surface 124*a*) and/or convex orientation (e.g., for a convex mounting surface 124*b*) provides a given desired beam distribution from lamp 100. For instance, consider FIGS. 18 and 18', which illustrate an example light beam distribution of a solid-state lamp 100 configured in accordance with an embodiment of the present disclosure. Furthermore, consider FIGS. 19A-19B, which illustrate an example light beam distribution of a recessed can-type solid-state lamp 100 configured in accordance with another embodiment of the present disclosure. As previously discussed, mounting surface 124 may be provided, in part or in whole, by heat sink portion 120 and/or an optional mounting interface 121, in accordance with some embodiments.

Control of the solid-state light sources 130 of lamp 100 may be provided using any of a wide range of wired and/or wireless control interfaces 202. In accordance with some embodiments, a given control interface 202 may include: (1) a physical control layer; and/or (2) a software control layer. The physical control layer may include, for instance, one or more switches (e.g., a sliding switch, a rotary switch, a toggle switch, a push-button switch, or any other suitable switch, as will be apparent in light of this disclosure) configured for use in controlling solid-state emitters 132 of lamp 100 individually and/or in conjunction with one another (e.g., as one or more groupings of emitters 132). In some instances, one or more switches may be operatively coupled with a given controller 190, which in turn interprets the switch input and distributes the desired control signal(s) to one or more of the solid-state emitters 132 of a lamp 100. In some other instances, a given switch may be operatively coupled directly with one or more solid-state emitters 132 to control them directly. In some embodiments, the physical control layer may include one or more switches configured for activating pre-programmed lighting patterns/scenes using a given lamp 100. Other suitable configurations for the physical control layer of a given control interface 202 will depend on a given application and will be apparent in light of this disclosure.

The software control layer of a given control interface 202 may be configured, for instance, for use in controlling solid-state emitters 132 of lamp 100 individually and/or in conjunction with one another (e.g., as one or more groupings of emitters 132). In accordance with some embodiments, the software control layer may be configured to customize the lighting distribution in a given space, for example, by intelligently controlling the solid-state emitters 132 of a lamp 100. For instance, the software control layer may be configured, in some embodiments, to intelligently determine how to dim the output level of one or more of the individual solid-state emitters 132 of a lamp 100 to achieve a given brightness and/or color. In some embodiments, the software control layer may be configured to program lighting patterns/scenes. In some instances, if lamp 100 includes on-board memory, for example, a programmed lighting pattern/scene may be saved and accessed through the software control layer and/or physical control layer of control interface 202. In an example case, a given lighting pattern/scene may be accessed, for instance, as a default setting/configuration whenever lamp 100 is turned ON.

Figure 20:
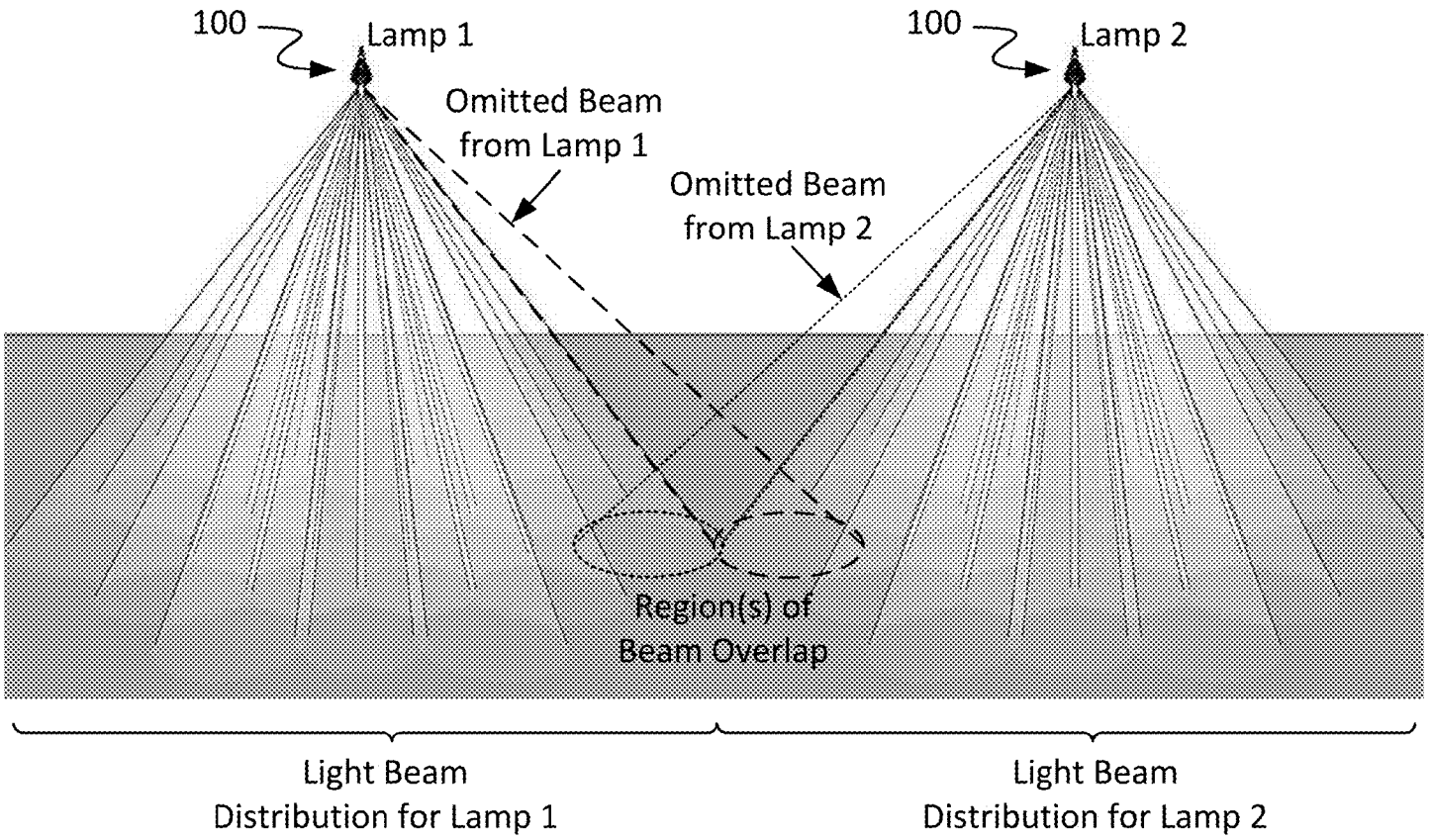
FIG. 20 illustrates example light beam distributions of neighboring solid-state lamps configured in accordance with an embodiment of the present disclosure.

In some cases, neighboring lamps 100 may be installed or otherwise positioned such that there their respective beam distributions would overlap, at least to some degree. For instance, consider FIG. 20, which illustrates example light beam distributions of neighboring solid-state lamps 100 configured in accordance with an embodiment of the present disclosure. As can be seen in this example case, a first lamp 100 (Lamp 1) is configured to output a first beam distribution, and a neighboring lamp 100 (Lamp 2) is configured to output a second beam distribution that would overlap, at least in part, with that of Lamp 1. As will be appreciated in light of this disclosure, it may be desirable, in some instances, to prevent or otherwise reduce such beam overlap (e.g., to improve output efficiency for the lamps 100 of interest. To that end, the software control layer may be configured, in accordance with some embodiments, to determine how the output beams of neighboring lamps 100 would overlap and to determine how to manipulate the beam distribution of a given lamp 100 to achieve the illumination desired. In accordance with some embodiments, the software control layer may determine which individual solid-state lights sources 130 of those lamps 100 of interest are optimally (or otherwise preferably) used in lighting a given space.

Thus, and in accordance with some embodiments, the software control layer of a given control interface 202 may control the output so as to prevent or otherwise reduce beam overlap between the neighboring lamps 100. In some cases, control interface 202 may be configured to ensure that neighboring lamps 100 omit one or more output beams that would overlap undesirably. The would-be beam overlap of neighboring lamps 100 may be determined, in some embodiments, by the software control layer of a given control interface 202 using any of wide range of data, such as: the mounting location of the lamps 100 of interest; the separation distance and/or angle of the neighboring lamps 100 of interest; the distance and/or angle between a lamp 100 of interest and the surface of incidence for its output; and/or a combination of any one or more thereof. In some instances, such information may be programmed into or otherwise native to a given lamp 100, whereas in some other instances, control interface 202 may be configured to obtain such information, automatically and/or upon user instruction. In accordance with some embodiments, the solid-state light sources 130 of neighboring lamps 100 may be manipulated to provide seamless, but not overlapping output beam distributions. It should be noted, however, that the present disclosure is not so limited only to prevention of output overlap, as in accordance with some embodiments, some degree of overlapping of the output of neighboring lamps 100 may be intentionally provided, for example, to provide for color tuning Other suitable configurations for the software control layer of a given control interface 202 will depend on a given application and will be apparent in light of this disclosure.

In some embodiments, a touch-sensitive device or surface, such as a touchpad or other device with a touch-based user interface (UI), may be utilized in controlling the solid-state emitters 132 of solid-state lamp 100 individually and/or in conjunction with one another (e.g., as one or more groupings of emitters 132). In some instances, the touch-sensitive UI may be operatively coupled with one or more controllers 190, which in turn interpret the input from the control interface 202 and provide the desired control signal(s) to one or more of the solid-state emitters 132 of a lamp 100. In some other instances, the touch-sensitive UI may be operatively coupled directly with one or more solid-state emitters 132 to control them directly.

In some embodiments, a computer vision system that is, for example, gesture-sensitive, activity-sensitive, and/or motion-sensitive may be utilized to control the solid-state emitters 132 of a given solid-state lamp 100 individually and/or in conjunction with one another (e.g., as one or more groupings of emitters 132). In some such cases, this may provide for a lamp 100 which can automatically adapt its light emissions based on a particular gesture-based command, sensed activity, or other stimulus. In some instances, the computer vision system may be operatively coupled with one or more controllers 190, which in turn interpret the input from the control interface 202 and provide the desired control signal(s) to one or more of the solid-state emitters 132 of a lamp 100. In some other instances, the computer vision system may be operatively coupled directly with one or more solid-state emitters 132 to control them directly. Other suitable configurations and capabilities for a given controller 190 and the one or more control interfaces 202 will depend on a given application and will be apparent in light of this disclosure.

In some embodiments, lamp 100 may be configured, for example, such that no two of its solid-state emitters 132 are pointed at the same spot on a given surface of incidence. Thus, there may be a one-to-one mapping of the solid-state light sources 130 of lamp 100 to the beam spots which it produces on a given surface of incidence. This one-to-one mapping may provide for pixelated control over the light distribution of lamp 100, in accordance with some embodiments. That is, lamp 100 may be capable of outputting a polar, grid-like pattern of light beam spots which can be manipulated (e.g., in intensity, etc.), for instance, like the regular, rectangular grid of pixels of a display. Like the pixels of a display, the beam spots produced by lamp 100 can have minimal or otherwise negligible overlap, in accordance with some embodiments. This may allow the light distribution of lamp 100 to be manipulated in a manner similar to the way that the pixels of a display can be manipulated to create different patterns, spot shapes, and distributions of light, in accordance with some embodiments. Furthermore, lamp 100 may exhibit minimal or otherwise negligible overlap of the angular distributions of light of its solid-state emitters 132, and thus the candela distribution can be adjusted (e.g., in intensity, etc.) as desired for a given target application or end-use. As will be appreciated in light of this disclosure, however, lamp 100 also may be configured to provide for pointing two or more solid-state emitters 132 at the same spot (e.g., such as when color mixing using multiple color solid-state emitters 132 is desired), in accordance with some embodiments.

Numerous embodiments will be apparent in light of this disclosure. One example embodiment provides a lighting method including: powering first and second solid-state lamps, each such lamp including: a base configured to engage a power socket; a plurality of solid-state emitters arranged over a non-planar interior surface of the lamp, wherein at least one of the solid-state emitters is individually addressable to customize its emissions; and one or more focusing optics optically coupled with the plurality of solid-state emitters; and electronically manipulating beam distribution of the first and second lamps to provide first and second beam distributions, respectively, wherein the first and second beam distributions are different from one another. In some cases, electronically manipulating beam distribution of the first and second lamps to provide first and second beam distributions, respectively, includes reducing beam distribution overlap between the first and second lamps. In some cases, electronically manipulating beam distribution of the first and second lamps is performed via a control interface configured for communicative coupling with each of the first and second lamps. In some such cases, the control interface is configured to automatically command the first and second distributions based on user input. In some cases, the control interface is configured to reduce beam distribution overlap of the first and second lamps utilizing data pertaining to at least one of a mounting location of at least one of the first and second lamps, a separation distance between the first and second lamps, and a distance between the first and second lamps and a corresponding surface of incidence of their respective beam distributions. In some instances, the non-planar interior surface is concave and is of hemispherical or hyper-hemispherical geometry. In some other instances, the non-planar interior surface is convex and is of hemispherical or hyper-hemispherical geometry. In some instances, the non-planar interior surface is faceted. In some cases, each of the first and second lamps further includes a heat sink configured to provide the non-planar interior surface. In some other cases, each of the first and second lamps further includes a heat sink and a mounting interface coupled with the heat sink, the mounting interface configured to provide the non-planar interior surface. In some cases, the at least one of the solid-state emitters is a grouping of solid-state emitters. In some such cases, at least one solid-state emitter of the grouping is individually addressable. In some instances, each of the first and second lamps further includes a controller communicatively coupled with at least one of the plurality of solid-state emitters and configured to output a control signal to electronically control light emitted thereby. In some such instances, the plurality of solid-state emitters are electronically controlled independently of one another by the controller. In some other such instances, the plurality of solid-state emitters are electronically controlled in one or more groupings by the controller. In some instances, the controller is configured to output a control signal that adjusts at least one of beam direction, beam angle, beam diameter, beam distribution, brightness, and/or color of light emitted by at least one of the plurality of solid-state emitters. In some instances, the controller utilizes at least one of a digital multiplexer (DMX) interface protocol, a Wi-Fi protocol, a Bluetooth protocol, a digital addressable lighting interface (DALI) protocol, a ZigBee protocol, a KNX protocol, an EnOcean protocol, a TransferJet protocol, an ultra-wideband (UWB) protocol, a WiMAX protocol, a high performance radio metropolitan area network (HiperMAN) protocol, an infrared data association (IrDA) protocol, a Li-Fi protocol, an IPv6 over low power wireless personal area network (6LoWPAN) protocol, a MyriaNed protocol, a WirelessHART protocol, a DASH7 protocol, a near field communication (NFC) protocol, a Wavenis protocol, a RuBee protocol, a Z-Wave protocol, an Insteon protocol, a ONE-NET protocol, and/or an X10 protocol. In some cases, each of the first and second lamps further includes a driver operatively coupled with at least one of their respective pluralities of solid-state emitters and configured to adjust at least one of an ON/OFF state, a brightness level, a color of emissions, a correlated color temperature (CCT), and/or a color saturation thereof, wherein the respective drivers utilize a dimming protocol. In some such cases, the dimming protocol includes at least one of pulse-width modulation (PWM) dimming, current dimming, triode for alternating current (TRIAC) dimming, constant current reduction (CCR) dimming, pulse-frequency modulation (PFM) dimming, pulse-code modulation (PCM) dimming, and/or line voltage (mains) dimming.

Another example embodiment provides a lighting method including: powering first and second solid-state lamps, each such lamp including: a base configured to engage a power socket; a heat sink having a non-planar interior surface; a plurality of light-emitting diodes (LEDs) arranged over the non-planar interior surface of the heat sink, wherein at least one of the LEDs is individually addressable to customize its emissions; one or more focusing optics optically coupled with the plurality of LEDs; and a driver electronically coupled with at least one of the plurality of LEDs and configured to electronically control output thereof via a dimming protocol; and electronically manipulating beam distribution of the first and second lamps to provide two distinct beam distributions. In some cases, the non-planar interior surface of the heat sink is concave and is of hemispherical or hyper-hemispherical geometry. In some other cases, the non-planar interior surface of the heat sink is convex and is of hemispherical or hyper-hemispherical geometry. In some instances, each of the first and second lamps further includes at least one of a parabolic aluminized reflector (PAR), a bulged reflector (BR), a multi-faceted reflector (MR), and/or a pre-positioning block disposed between the heat sink and at least one of the LEDs. In some cases, the at least one of the LEDs is a grouping of LEDs. In some such cases, at least one LED of the grouping is individually addressable. In some instances, the dimming protocol includes at least one of pulse-width modulation (PWM) dimming, current dimming, triode for alternating current (TRIAC) dimming, constant current reduction (CCR) dimming, pulse-frequency modulation (PFM) dimming, pulse-code modulation (PCM) dimming, and/or line voltage (mains) dimming. In some instances, each of the first and second lamps further includes a transceiver communicatively coupled with the driver.

Another example embodiment provides a lighting method including: powering first and second solid-state lamps, each such lamp including: a base configured to engage a power socket; a heat sink; a mounting interface thermally coupled with the heat sink and configured to provide a non-planar surface within the lamp; a plurality of light-emitting diodes (LEDs) arranged over the non-planar surface of the mounting interface, wherein at least one of the LEDs is individually addressable to customize its emissions; one or more focusing optics optically coupled with the plurality of LEDs; and a driver electronically coupled with at least one of the plurality of LEDs and configured to electronically control output thereof via a dimming protocol; and electronically manipulating beam distribution of the first and second lamps to provide two distinct beam distributions. In some cases, the non-planar surface of the mounting interface is concave and is of hemispherical or hyper-hemispherical geometry. In some other cases, the non-planar surface of the mounting interface is convex and is of hemispherical or hyper-hemispherical geometry. In some instances, the mounting interface includes at least one of a parabolic aluminized reflector (PAR), a bulged reflector (BR), a multi-faceted reflector (MR), and/or a pre-positioning block. In some cases, the at least one of the LEDs is a grouping of LEDs. In some such cases, at least one LED of the grouping is individually addressable. In some instances, the dimming protocol includes at least one of pulse-width modulation (PWM) dimming, current dimming, triode for alternating current (TRIAC) dimming, constant current reduction (CCR) dimming, pulse-frequency modulation (PFM) dimming, pulse-code modulation (PCM) dimming, and/or line voltage (mains) dimming. In some instances, each of the first and second lamps further includes a transceiver communicatively coupled with the driver.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. A lighting method comprising:

powering first and second solid-state lamps, each such lamp comprising:

a base configured to engage a power socket;

a plurality of solid-state emitters arranged over a non-planar interior surface of the lamp, wherein at least one of the solid-state emitters is individually addressable to customize its emissions; and one or more focusing optics optically coupled with the plurality of solid-state emitters; and electronically manipulating beam distribution of the first and second lamps to provide first and second beam distributions, respectively, wherein the first and second beam distributions are different from one another and electronically manipulating beam distribution of the first and second lamps is performed via a control interface configured for communicative coupling with each of the first and second lamps.

2. The lighting method of claim 1, wherein electronically manipulating beam distribution of the first and second lamps to provide first and second beam distributions, respectively, includes reducing beam distribution overlap between the first and second lamps.

3. The lighting method of claim 1, wherein the control interface is configured to automatically command the first and second distributions based on user input.

4. The lighting method of claim 1, wherein the control interface is configured to reduce beam distribution overlap of the first and second lamps utilizing data pertaining to at least one of a mounting location of at least one of the first and second lamps, a separation distance between the first and second lamps, and a distance between the first and second lamps and a corresponding surface of incidence of their respective beam distributions.

5. The lighting method of claim 1, wherein the non-planar interior surface is concave and is of hemispherical or hyper-hemispherical geometry.

6. The lighting method of claim 1, wherein the non-planar interior surface is convex and is of hemispherical or hyper-hemispherical geometry.

7. The lighting method of claim 1, wherein the non-planar interior surface is faceted.

8. The lighting method of claim 1, wherein each of the first and second lamps further comprises a heat sink configured to provide the non-planar interior surface.

9. The lighting method of claim 1, wherein each of the first and second lamps further comprises a heat sink and a mounting interface coupled with the heat sink, the mounting interface configured to provide the non-planar interior surface.

10. The lighting method of claim 1, wherein the at least one of the solid-state emitters is a grouping of solid-state emitters.

11. The lighting method of claim 10, wherein at least one solid-state emitter of the grouping is individually addressable.

12. The lighting method of claim 1, wherein each of the first and second lamps further comprises a controller communicatively coupled with at least one of the plurality of solid-state emitters and configured to output a control signal to electronically control light emitted thereby.

13. The lighting method of claim 12, wherein the plurality of solid-state emitters are electronically controlled independently of one another by the controller.

14. The lighting method of claim 12, wherein the plurality of solid-state emitters are electronically controlled in one or more groupings by the controller.

15. The lighting method of claim 12, wherein the controller is configured to output a control signal that adjusts at least one of beam direction, beam angle, beam diameter, beam distribution, brightness, and/or color of light emitted by at least one of the plurality of solid-state emitters.

16. The lighting method of claim 12, wherein the controller utilizes at least one of a digital multiplexer (DMX) interface protocol, a Wi-Fi protocol, a Bluetooth protocol, a digital addressable lighting interface (DALI) protocol, a ZigBee protocol, a KNX protocol, an EnOcean protocol, a TransferJet protocol, an ultra-wideband (UWB) protocol, a WiMAX protocol, a high performance radio metropolitan area network (HiperMAN) protocol, an infrared data association (IrDA) protocol, a Li-Fi protocol, an IPv6 over low power wireless personal area network (6LoWPAN) protocol, a MyriaNed protocol, a WirelessHART protocol, a DASH7 protocol, a near field communication (NFC) protocol, a Wavenis protocol, a RuBee protocol, a Z-Wave protocol, an Insteon protocol, a ONE-NET protocol, and/or an X10 protocol.

17. The lighting method of claim 1, wherein each of the first and second lamps further comprises a driver operatively coupled with at least one of their respective pluralities of solid-state emitters and configured to adjust at least one of an ON/OFF state, a brightness level, a color of emissions, a correlated color temperature (CCT), and/or a color saturation thereof, wherein the respective drivers utilize a dimming protocol.

18. The lighting method of claim 17, wherein the dimming protocol comprises at least one of pulse-width modulation (PWM) dimming, current dimming, triode for alternating current (TRIAC) dimming, constant current reduction (CCR) dimming, pulse-frequency modulation (PFM) dimming, pulse-code modulation (PCM) dimming, and/or line voltage (mains) dimming.

19. A lighting method comprising:

powering first and second solid-state lamps, each such lamp comprising:

a base configured to engage a power socket;

a heat sink having a non-planar interior surface;

a plurality of light-emitting diodes (LEDs) arranged over the non-planar interior surface of the heat sink, wherein at least one of the LEDs is individually addressable to customize its emissions;

one or more focusing optics optically coupled with the plurality of LEDs; and a driver electronically coupled with at least one of the plurality of LEDs and configured to electronically control output thereof via a dimming protocol; and electronically manipulating beam distribution of the first and second lamps to provide two distinct beam distributions.

20. The lighting method of claim 19, wherein the non-planar interior surface of the heat sink is concave and is of hemispherical or hyper-hemispherical geometry.

21. The lighting method of claim 19, wherein the non-planar interior surface of the heat sink is convex and is of hemispherical or hyper-hemispherical geometry.

22. The lighting method of claim 19, wherein each of the first and second lamps further comprises at least one of a parabolic aluminized reflector (PAR), a bulged reflector (BR), a multi-faceted reflector (MR), and/or a pre-positioning block disposed between the heat sink and at least one of the LEDs.

23. The lighting method of claim 19, wherein the at least one of the LEDs is a grouping of LEDs.

24. The lighting method of claim 23, wherein at least one LED of the grouping is individually addressable.

25. The lighting method of claim 19, wherein the dimming protocol comprises at least one of pulse-width modulation (PWM) dimming, current dimming, triode for alternating current (TRIAC) dimming, constant current reduction (CCR) dimming, pulse-frequency modulation (PFM) dimming, pulse-code modulation (PCM) dimming, and/or line voltage (mains) dimming.

26. The lighting method of claim 19, wherein each of the first and second lamps further comprises a transceiver communicatively coupled with the driver.

27. A lighting method comprising:

powering first and second solid-state lamps, each such lamp comprising:

a base configured to engage a power socket;

a heat sink;

a mounting interface thermally coupled with the heat sink and configured to provide a non-planar surface within the lamp;

a plurality of light-emitting diodes (LEDs) arranged over the non-planar surface of the mounting interface, wherein at least one of the LEDs is individually addressable to customize its emissions;

one or more focusing optics optically coupled with the plurality of LEDs; and a driver electronically coupled with at least one of the plurality of LEDs and configured to electronically control output thereof via a dimming protocol; and electronically manipulating beam distribution of the first and second lamps to provide two distinct beam distributions and wherein electronically manipulating beam distribution of the first and second lamps is performed via a control interface configured for communicative coupling with each of the first and second lamps and wherein the control interface is configured to automatically command the first and second distributions based on a single user input.

* * * * *